US010689222B2

(12) United States Patent
Yoneyama et al.

(10) Patent No.: US 10,689,222 B2
(45) Date of Patent: Jun. 23, 2020

(54) SHEET PROCESSING APPARATUS AND IMAGE FORMING SYSTEM INCORPORATING THE SAME

(71) Applicants: Fumiharu Yoneyama, Kanagawa (JP); Shinji Asami, Tokyo (JP); Akira Kunieda, Tokyo (JP); Tomohiro Furuhashi, Kanagawa (JP); Michitaka Suzuki, Kanagawa (JP); Tomomichi Hoshino, Kanagawa (JP); Makoto Hidaka, Tokyo (JP); Koki Sakano, Kanagawa (JP); Takuya Morinaga, Tokyo (JP); Yohsuke Haraguchi, Kanagawa (JP)

(72) Inventors: Fumiharu Yoneyama, Kanagawa (JP); Shinji Asami, Tokyo (JP); Akira Kunieda, Tokyo (JP); Tomohiro Furuhashi, Kanagawa (JP); Michitaka Suzuki, Kanagawa (JP); Tomomichi Hoshino, Kanagawa (JP); Makoto Hidaka, Tokyo (JP); Koki Sakano, Kanagawa (JP); Takuya Morinaga, Tokyo (JP); Yohsuke Haraguchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/275,485

(22) Filed: Feb. 14, 2019

(65) Prior Publication Data

US 2019/0284012 A1 Sep. 19, 2019

(30) Foreign Application Priority Data

Mar. 19, 2018 (JP) ..... 2018-050378
Oct. 29, 2018 (JP) ..... 2018-202474

(51) Int. Cl.
*B65H 45/16* (2006.01)
*B65H 29/14* (2006.01)
*B65H 45/04* (2006.01)

(52) U.S. Cl.
CPC ..... *B65H 45/16* (2013.01); *B65H 29/14* (2013.01); *B65H 45/04* (2013.01); *G03G 2215/00877* (2013.01)

(58) Field of Classification Search
CPC ..... B65H 45/04; B65H 45/12; G03G 2215/00877
(Continued)

(56) References Cited

U.S. PATENT DOCUMENTS 8,532,560 B2 * 9/2013 Mizuno ..... B65H 29/125 271/188
9,302,880 B2 * 4/2016 Awano ..... B65H 45/18
(Continued)

FOREIGN PATENT DOCUMENTS

JP 2014-101164 6/2014
JP 2016-055951 4/2016
JP 2016-079015 5/2016

*Primary Examiner* — Leslie A Nicholson, III
(74) *Attorney, Agent, or Firm* — Harness, Dickey & Pierce, P.L.C.

(57) ABSTRACT

A sheet processing apparatus includes a rotatable pressing member, a guide, and a contact member. The rotatable pressing member includes a pressing portion that is disposed in a predetermined range in a rotation direction of the pressing member to press a folded portion of a sheet. The guide is disposed opposite the pressing member. The contact member contacts the guide and is rotatably disposed at at least one end of the pressing member in an axial direction of the pressing member.

20 Claims, 23 Drawing Sheets

(58) Field of Classification Search
USPC ..... 270/32; 493/435
See application file for complete search history.

(56) References Cited

U.S. PATENT DOCUMENTS

| | | | | |
|---|---|---|---|---|
| 9,302,881 | B2 * | 4/2016 | Awano | B65H 29/125 |
| 9,637,342 | B2 * | 5/2017 | Hari | B65H 37/06 |
| 9,993,987 | B2 * | 6/2018 | Suzuki | B31F 1/0025 |
| 10,059,558 | B2 * | 8/2018 | Suzuki | B65H 45/14 |
| 10,363,757 | B2 * | 7/2019 | Iwata | B65H 29/58 |
| 2014/0141956 | A1 | 5/2014 | Suzuki et al. | |
| 2014/0203486 | A1 | 7/2014 | Sugiyama et al. | |
| 2014/0203487 | A1 | 7/2014 | Hoshino et al. | |
| 2014/0203488 | A1 | 7/2014 | Hidaka et al. | |
| 2014/0206516 | A1 | 7/2014 | Hata et al. | |
| 2014/0206517 | A1 | 7/2014 | Kikuchi et al. | |
| 2014/0206518 | A1 | 7/2014 | Hidaka et al. | |
| 2014/0206519 | A1 | 7/2014 | Hoshino et al. | |
| 2014/0213425 | A1 | 7/2014 | Sugiyama et al. | |
| 2014/0336031 | A1 | 11/2014 | Suzuki et al. | |
| 2014/0364295 | A1 | 12/2014 | Watanabe et al. | |
| 2015/0031520 | A1 | 1/2015 | Nakada et al. | |
| 2015/0225201 | A1 | 8/2015 | Watanabe et al. | |
| 2015/0266697 | A1 | 9/2015 | Saito et al. | |
| 2015/0329309 | A1 * | 11/2015 | Iwata | B41J 11/04 493/409 |
| 2016/0060072 | A1 | 3/2016 | Watanabe et al. | |
| 2016/0068359 | A1 | 3/2016 | Suzuki et al. | |
| 2016/0114999 | A1 | 4/2016 | Suzuki et al. | |
| 2016/0115000 | A1 | 4/2016 | Sugiyama et al. | |
| 2018/0201466 | A1 | 7/2018 | Saito et al. | |
| 2018/0236744 | A1 * | 8/2018 | Suzuki | B31F 1/0025 |
| 2018/0257900 | A1 * | 9/2018 | Suzuki | B65H 45/14 |

* cited by examiner

SHEET PROCESSING APPARATUS AND IMAGE FORMING SYSTEM INCORPORATING THE SAME

CROSS-REFERENCE TO RELATED APPLICATIONS

This patent application is based on and claims priority pursuant to 35 U.S.C. § 119 to Japanese Patent Applications No. 2018-050378, filed on Mar. 19, 2018, and No. 2018-202474, filed on Oct. 29, 2018 in the Japanese Patent Office, the entire disclosure of each of which is hereby incorporated by reference herein.

BACKGROUND

Technical Field

This disclosure relates to a sheet processing apparatus and an image forming system incorporating the sheet processing apparatus.

Description of the Related Art

Techniques exist for a sheet processing apparatus that includes a pressing member rotatably supported and having a pressing portion to press a folded portion of a sheet in a predetermined range in a rotation direction, and a guide opposite the pressing member.

SUMMARY

This specification describes an improved sheet processing apparatus that includes a rotatable pressing member, a guide, and a contact member. The rotatable pressing member includes a pressing portion that is disposed in a predetermined range in a rotation direction of the pressing member to press a folded portion of a sheet. The guide is disposed opposite the pressing member. The contact member contacts the guide and is rotatably disposed at at least one end of the pressing member in an axial direction of the pressing member.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
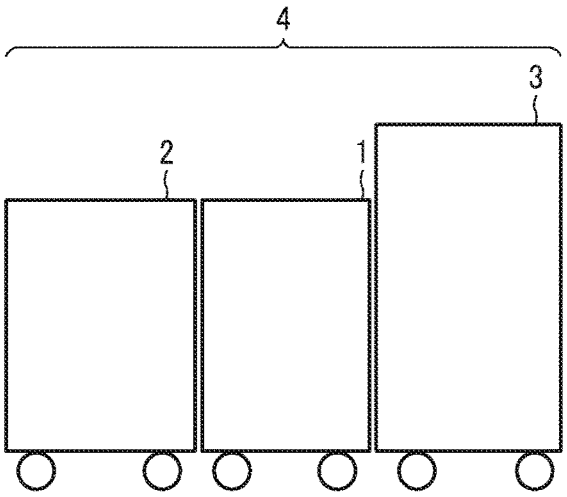
FIG. 1 is a schematic diagram illustrating a system configuration of an image forming system including an image forming apparatus and a plurality of sheet processing apparatuses according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference codes are allocated to elements (members or components) having the same function or shape and redundant descriptions thereof are omitted below.

FIG. 1 is a schematic diagram illustrating a system configuration of an image forming system 4 according to an embodiment of the present disclosure, including an image forming apparatus and a plurality of sheet processing apparatuses. The image forming system 4 in the present embodiment includes a folding apparatus 1 and a post-processing apparatus 2, each of which serves as the sheet processing apparatus, provided in this order at later stages of the image forming apparatus 3, as illustrated in FIG. 1.

The image forming apparatus 3 forms an image on a sheet based on image data that is input to the image forming apparatus 3 or obtained by scanning. The image forming apparatus 3 may be, for instance, a copier, a printer, a facsimile machine, or a multifunction peripheral having at least two functions of the foregoing machines. The image forming apparatus 3 may use any known image forming method, such as electrophotography or droplet discharge. The image forming apparatus 3 in the present embodiment is a copier using the electrophotography.

Examples of the post-processing apparatus 2 include a punch apparatus that punches a hole in the sheet, a sheet binding apparatus in which a stapler or the like binds sheets and make a sheet bundle, and a sorter that sorts and ejects a sheet on which an image formed into each of a plurality of ejection trays.

Figure 2:
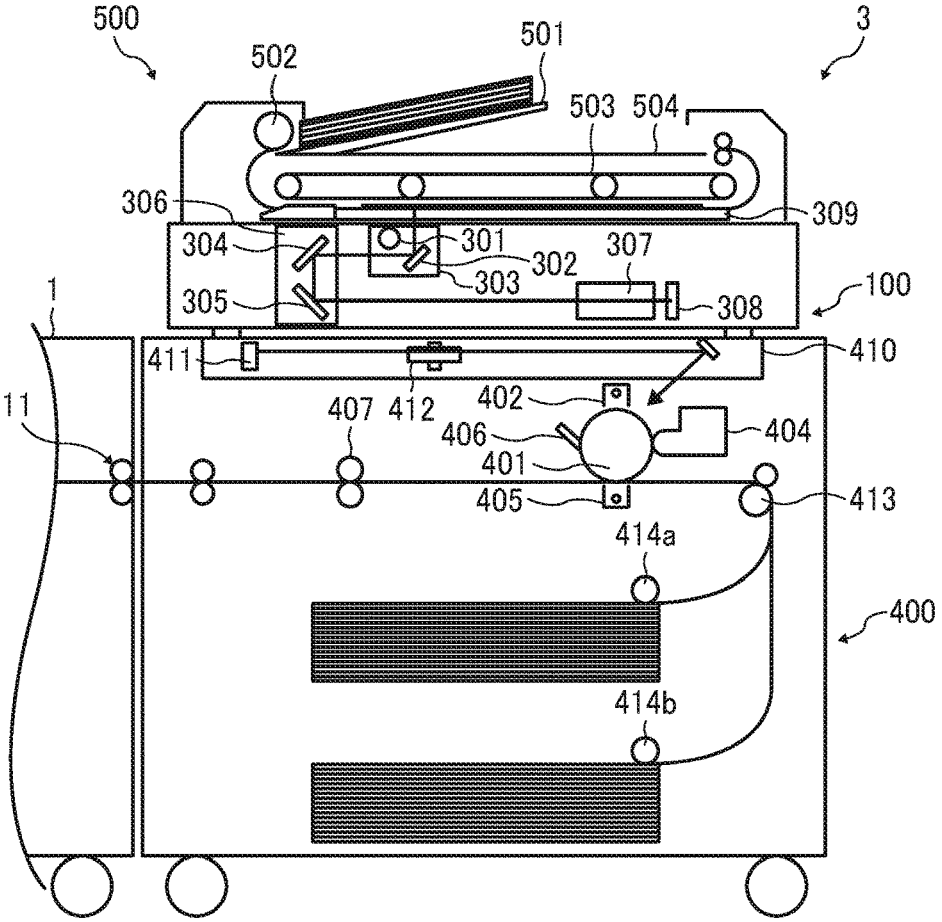
FIG. 2 is a schematic configuration diagram of an image forming apparatus provided in the image forming system of FIG. 1.

FIG. 2 is a schematic configuration diagram of the image forming apparatus 3 provided in the image forming system 4 according to the present embodiment.

In an image forming apparatus main body 400, feeding cassettes to store sheets serving as recording media are disposed below an image forming section. After a sheet stored in the feeding cassettes is fed by the feeding roller 414*a* or 414*b*, the sheet is conveyed upward along a predetermined conveyance path. Then the sheet reaches a registration roller pair 413.

The image forming section includes a photoconductor drum 401 as an image bearer, a charger 402, an exposure device 410, a developing device 404, a transfer device 405, and a cleaner 406.

The charger 402 uniformly charges a surface of the photoconductor drum 401. The exposure device 410 serving as a latent image forming device forms an electrostatic latent image on the photoconductor drum 401 based on image data read by a scanner 100. The developing device 404 adheres toner to the electrostatic latent image formed on the photoconductor drum 401 to form a visible image as a toner image. The transfer device 405 transfers the toner image from the photoconductor drum 401 onto the sheet. The cleaner 406 removes toner remaining on the photoconductor drum 401 after the transfer.

On the downstream side of the image forming section in the sheet conveyance direction, a fixing device 407 to fix the toner image on the sheet is disposed.

The exposure device 410 includes a laser unit 411 to emit a laser beam based on the image data under a control of a controller and a polygon mirror 412 to scan the laser beam from the laser unit 411 in a rotation axis direction of the photoconductor drum 401 which is called a main scanning direction.

An automatic document feeder (ADF) 500 is mounted on the scanner 100. The automatic document feeder (ADF) 500 includes a platen 501, a separation and feed roller 502, an original conveyor belt 503, and an original ejection tray 504.

When the automatic document feeder (ADF) 500 receives an instruction to start scanning originals placed on the platen 501, the separation and feed roller 502 feeds the originals one by one from the platen 501 to the original conveyor belt 503. The original conveyor belt 503 moves the originals onto a platen glass 309 on which each of the originals temporally stops.

Then, the scanner 100 reads the image data of the original temporarily stopped on the platen glass 309. Thereafter, the original conveyor belt 503 resumes conveyance of the original to eject the original onto the original ejection tray 504.

A more detailed description is now provided of an image reading operation and an image forming operation.

In addition to the platen glass 309, the scanner 100 includes a first carrier 303, a light source 301 and a mirror 302 provided on the first carrier 303, a second carrier 306, mirrors 304 and 305 provided on the second carrier 306, a lens 307, and a charge coupled device (CCD) 308. The light source 301 is lighted when the automatic document feeder (ADF) 500 conveys the original onto the platen glass 309 or when a user places an original on the platen glass 309 and directs the image forming apparatus to start copying via an operation panel. In the meantime, the first carrier 303 and the second carriers 306 move along a guide rail.

The light source 301 emits light to the original positioned on the platen glass 309. Reflected light from the original is guided to the CCD 308 via the mirror 302, the mirrors 304 and 305, and the lens 307. The CCD 308 receives the reflected light and reads the image data of the original. The image data is converted from analog to digital data by an analog-to-digital (A/D) converter. The digital data is sent from a data output unit to the controller in the image forming apparatus main body 400.

On the other hand, the image forming apparatus main body 400 starts to drive the photoconductor drum 401, and after a rotation speed of the photoconductor drum 401 reaches a predetermined speed, the charger 402 uniformly charges the surface of the photoconductor drum 401. The exposure device 410 forms the electrostatic latent image on the charged surface of the photoconductor drum 401 based on the image data read by the scanner 100.

Thereafter, the developing device 404 develops the electrostatic latent image on the surface of the photoconductor drum 401 into a toner image. In the meantime, the feeding roller 414*a* or 414*b* feeds the sheet stored in the feeding cassette, and the registration roller pair 413 temporarily stops the sheet.

The registration roller pair 413 feeds the sheet to a transfer portion opposed to the transfer device 405 when a leading edge of the toner image formed on the surface of the photoconductor drum 401 reaches the transfer portion. While the sheet passes through the transfer portion, a transfer electric field transfers the toner image formed on the surface of the photoconductor drum 401 onto the sheet.

The sheet on which the toner image is transferred is conveyed to the fixing device 407, subjected to a fixing process by the fixing device 407, and then discharged to the folding apparatus 1 at the subsequent stage. The cleaner 406 removes residual toner which is not transferred onto the sheet at the transfer portion and remains on the surface of the photoconductor drum 401.

Figure 3:
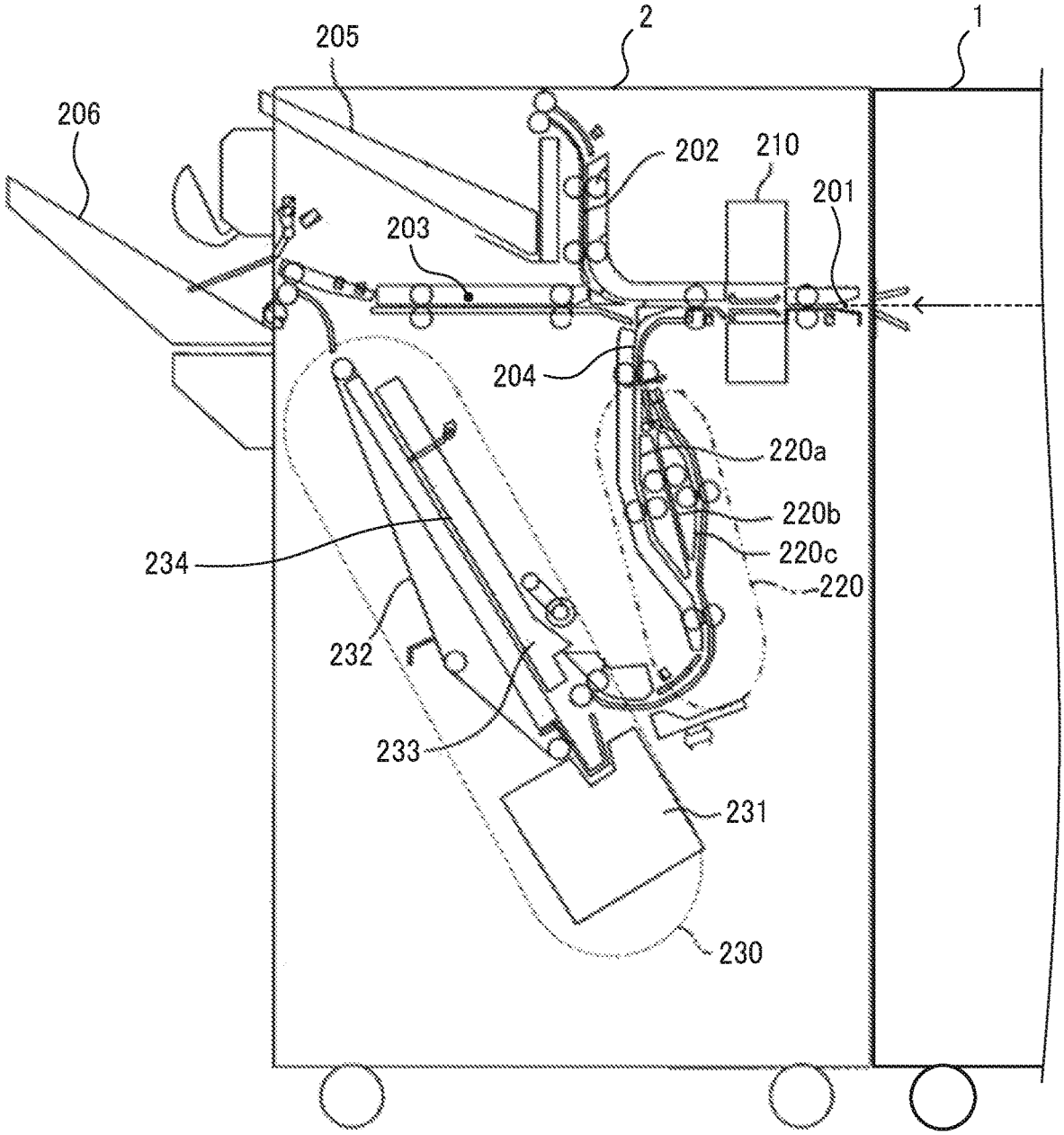
FIG. 3 is a schematic configuration diagram of a post-processing apparatus provided in the image forming system of FIG. 1.

FIG. 3 is a schematic configuration diagram of the post-processing apparatus 2 provided in the image forming system 4 according to the embodiment.

The post-processing apparatus 2 includes an introduction path 201 to receive the sheet from the folding apparatus 1 and three paths diverging from the introduction path 201, that is, a first ejection path 202 to eject the sheet to an upper tray 205, a second ejection path 203 to eject the sheet to a shift tray 206, and a conveyance path 204 to convey the sheet to a sheet binding device 230. On the introduction path 201, a punching device 210 is disposed to puncture a punch hole in the sheet. The punching device 210 punctures the punch hole at a predetermined position in a folded sheet, a folded sheet bundle, and a single sheet that has been conveyed without being folded, which are ejected from the folding apparatus 1.

On the conveyance path 204, an overlay device 220 is disposed. The overlay device 220 includes three conveyance paths 220*a*, 220*b*, and 220*c*. Sorting the sheets to each conveyance path and temporarily waiting on each conveyance path allows up to three sheets to be overlaid and conveyed.

The sheet binding device 230 includes a processing tray 233, a jogger fence 234 to align a plurality of sheets (that is a sheet bundle) in the processing tray 233, a stapler unit 231 to perform binding processing on the sheet bundle in the processing tray 233, and a conveyance belt 232 to convey the sheet bundle subjected to binding processing toward the shift tray 206.

When the predetermined number of sheets which are folded or not folded is conveyed to the processing tray 233, the jogger fence 234 performs the alignment processing on the sheet bundle in the processing tray 233. Then, after the stapler unit 231 performs the binding processing on the sheet bundle in the processing tray 233, the conveyance belt 232 conveys the bound sheet bundle, and the bound sheet bundle is ejected to the shift tray 206.

Figure 4:
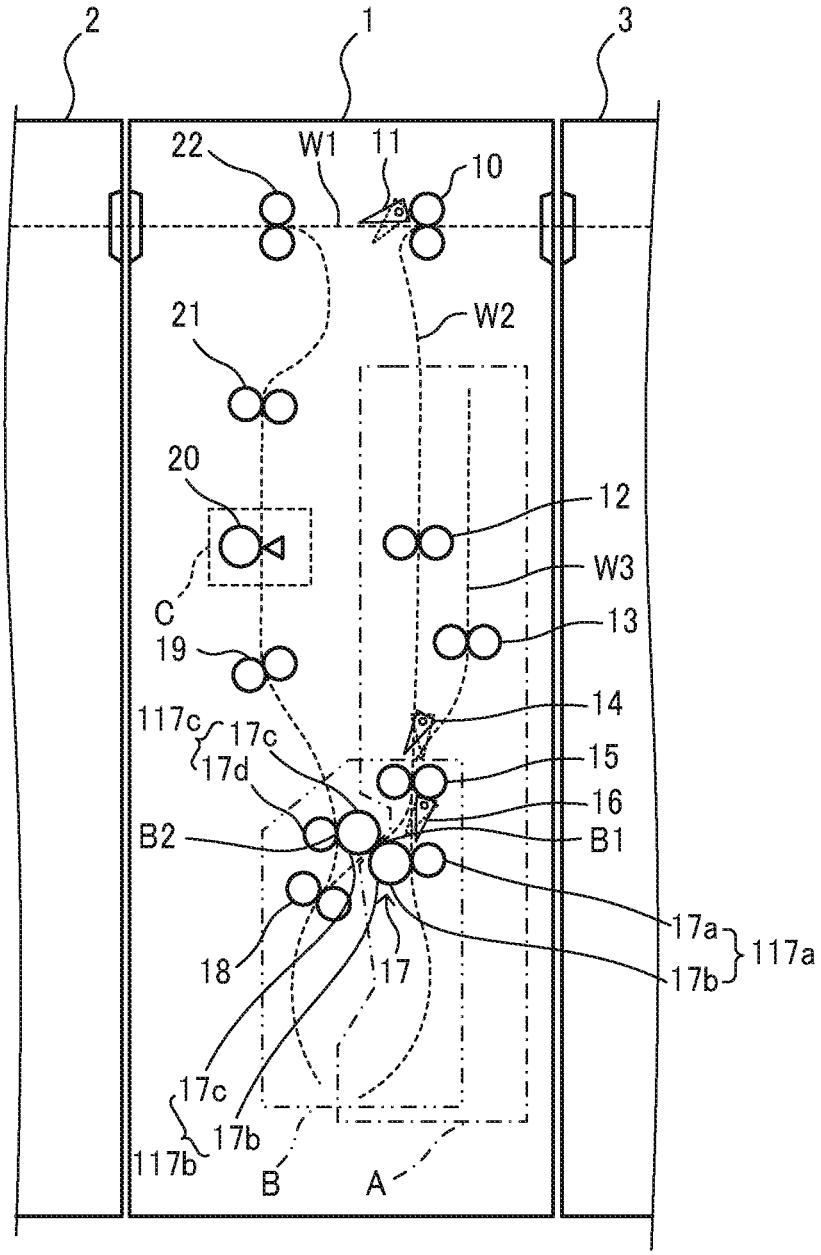
FIG. 4 is a schematic configuration diagram of a folding apparatus provided in the image forming system of FIG. 1.

FIG. 4 is a schematic configuration diagram of a folding apparatus 1 provided in the image forming system 4 according to the embodiment.

As illustrated in FIG. 4, the folding apparatus 1 includes an entry roller pair 10 to convey the sheet received from the image forming apparatus 3. On the downstream side from the entry roller pair 10, the sheet conveyance path is divided into a folding processing conveyance path W2 to convey the sheet and perform the folding processing and a through conveyance path W1 to convey the sheet without the folding processing. A first bifurcating claw 11 is disposed at a fork between the folding processing conveyance path W2 and the through conveyance path W1. The first bifurcating claw 11 guides the sheet to the through conveyance path W1 or the folding processing conveyance path W2.

The folding processing conveyance path W2 includes an overlay section A to overlap a plurality of sheets, a folding section B to fold one sheet or sheets overlaid in the overlay section A, and an additional folding section C in which the folded sheet is additionally folded.

The overlay section A includes a pair of registration rollers 15, a first conveyance roller pair 117*a* including a first pressing roller 17*a* in a folding mechanism 17 described later and a first folding roller 17*b*, and a conveyance roller pair 12 to convey the sheet toward the pair of registration rollers 15. The overlay section A also includes a switchback conveyance path W3 that branches from the folding processing conveyance path W2 between the conveyance roller pair 12 and the pair of registration rollers 15 and conveys the sheet conveyed in a reverse direction (conveyed in the opposite direction to the predetermined direction) by the pair of registration rollers 15, and a switchback conveying roller pair 13 disposed in the switchback conveyance path W3. The overlay section A also includes a second bifurcating claw 14 disposed at a fork between the switchback conveyance path W3 and the folding processing conveyance path W2 from the conveyance roller pair 12 to the pair of registration rollers 15 to guide the sheet conveyed in the reverse direction (conveyed in the opposite direction to the predetermined direction) toward the switchback conveyance path W3.

The folding section B is disposed downstream of the overlapping section A. The folding section B includes the pair of registration rollers 15, the folding mechanism 17, and a second conveyance roller pair 18. The folding mechanism 17 includes the first folding roller 17*b*, the first pressing roller 17*a* which contacts the first folding roller 17*b* to switch back the sheet, a second folding roller 17*c* which contacts the first folding roller 17*b* to form a first folding nip B1, and a second pressing roller 17*d* which contacts the second folding roller 17*c* to form a second folding nip B2. The driving force is transmitted to one of the plurality of rollers included in the folding mechanism 17, and the other rollers are driven to rotate.

A third bifurcating claw 16 is disposed downstream of the pair of registration rollers 15 to guide the sheet to the nip between the first folding roller 17*b* and the first pressing roller 17*a* or the first folding nip B1.

On the downstream side of the folding section B, the additional folding section C is disposed. The additional folding section C includes an additional folding roller 20. The additional folding roller 20 has a pressing convex portion, and the pressing convex portion presses the folded portion of the sheet, and the folded portion of the sheet is additionally folded.

Figure 5:
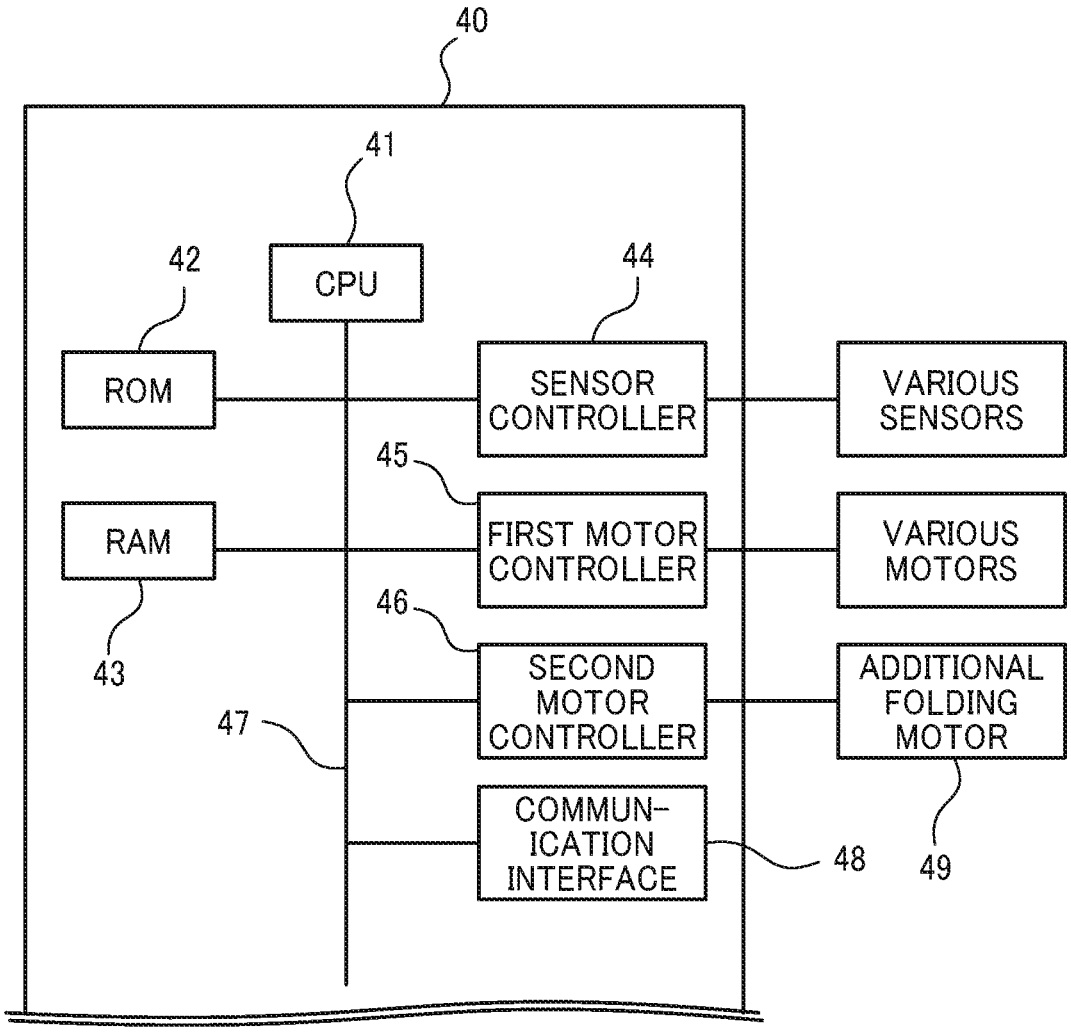
FIG. 5 is a block diagram of an example of a control circuit to control the folding apparatus of the image forming system of FIG. 1.

FIG. 5 is a block diagram of an example of a control circuit to control the folding apparatus 1 in the image forming system 4.

The controller 40 to control the folding apparatus 1 includes a Central Processing Unit (CPU) 41, a Read Only Memory (ROM) 42, a Random Access Memory (RAM) 43, a sensor controller 44 to control various sensors such as a paper detection sensor disposed in the folding apparatus 1, a first motor controller 45 to control a plurality of conveyance motors which convey the sheet in the folding apparatus 1, a second motor controller 46 to control the additional folding motor 49 drives the additional folding roller 20, and a communication interface 48.

These components are mutually electrically coupled via a bus line 47 such as an address bus or a data bus. The communication interface 48 communicates with the image forming apparatus 3 and the post-processing apparatus 2 in FIG. 1 and exchanges data necessary for control. The ROM 42 stores data and programs executed by the CPU 41. The CPU 41 executes a computer readable program stored in the ROM 42 to control the folding apparatus 1. The RAM 43 temporarily stores data when the CPU 41 executes the program.

FIGS. 6A to 6F are explanatory diagrams illustrating the sheet overlay operation executed by the overlay device A of the folding apparatus 1.

Figure 6A:
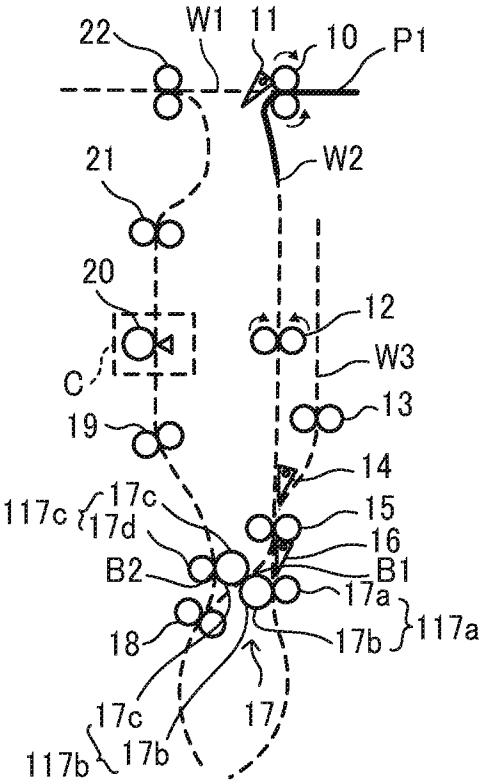
FIGS. 6A to 6F are explanatory diagrams illustrating a sheet overlay operation executed by an overlay device of the folding apparatus.

As illustrated in FIG. 6A, the entry roller pair 10 conveys the first sheet P1 to the folding processing conveyance path W2. A leading edge of the first sheet P1 conveyed to the folding processing conveyance path W2 contacts the pair of registration rollers 15 to correct the skew of the preceding sheet. However, this skew correction may not be performed.

Figure 6B:
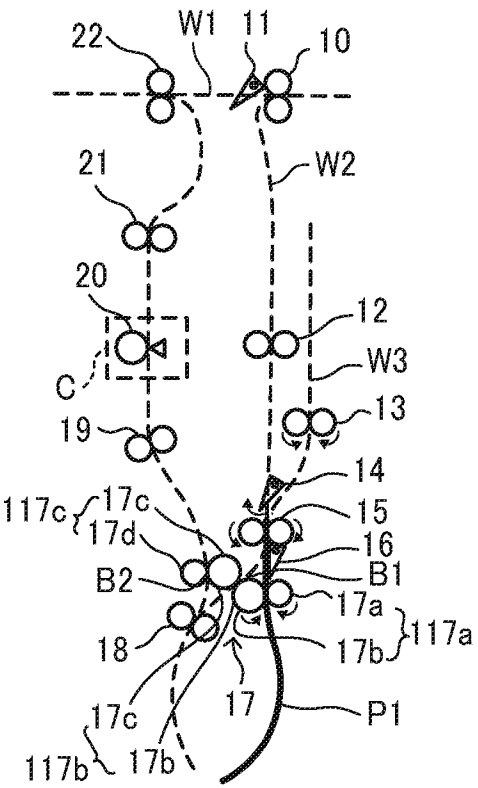
Figure 6C:
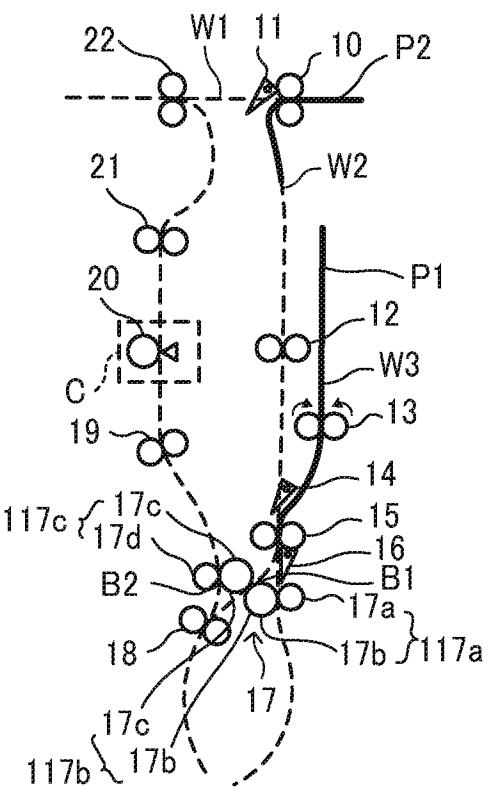

Next, the pair of registration rollers 15 and the first conveyance roller pair 117*a* serving as a first conveyance member including the first pressing roller 17*a* and the first folding roller 17*b* conveys the first sheet P1 in a predetermined direction which is called a regular direction. Next, when the trailing edge of the first sheet P1 passes through the fork between the folding processing conveyance path W2 and the switchback conveyance path W3, the conveyance of the first sheet P1 is stopped. Next, the second bifurcating claw 14 pivots in the clockwise direction in FIG. 6B, and the posture of the second bifurcating claw 14 is switched to guide the sheet P1 to the switchback conveyance path W3. Next, as illustrated in FIG. 6B, the pair of registration rollers 15, the first conveyance roller pair 117*a*, and the switchback conveying roller pair 13 rotate in reverse. This reverse rotation conveys the first sheet P1 in a reverse direction that is the opposite direction to the predetermined direction, and the first sheet P1 is conveyed to the switchback conveyance path W3. When the leading edge of the first sheet P1 in the regular direction is conveyed to the switchback conveyance path W3, the switchback conveying roller pair 13 stops the conveyance of the first sheet P1. After stopping the conveyance of the first sheet P1, as illustrated in FIG. 6C, the switchback conveying roller pair 13 conveys the first sheet P1 in the regular direction, strikes the leading edge of the first sheet P1 against the pair of registration rollers 15 to correct the skew, and puts the first sheet P1 on standby.

In this way, by conveying the preceding sheet P1 to the switchback conveyance path W3 and withdrawing the preceding sheet P1 from the folding processing conveyance path W2, the preceding sheet P1 does not obstruct the conveyance of a succeeding second sheet P2, thereby enabling smooth conveyances of the second sheet P2.

Figure 6D:
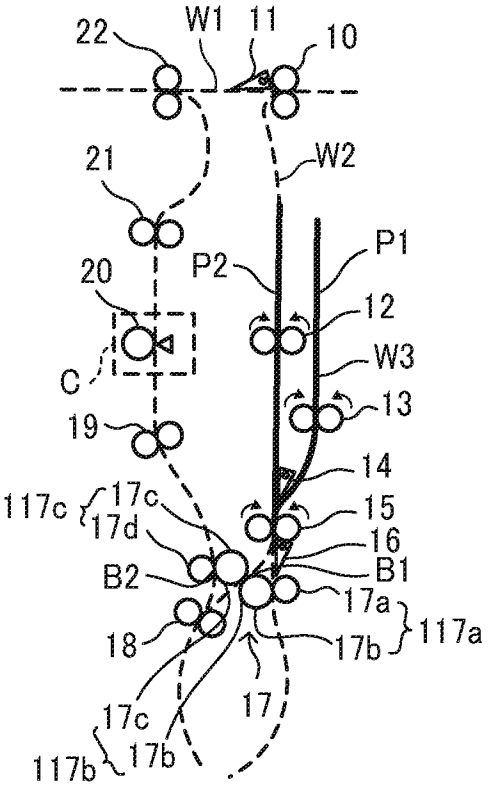
Figure 6E:
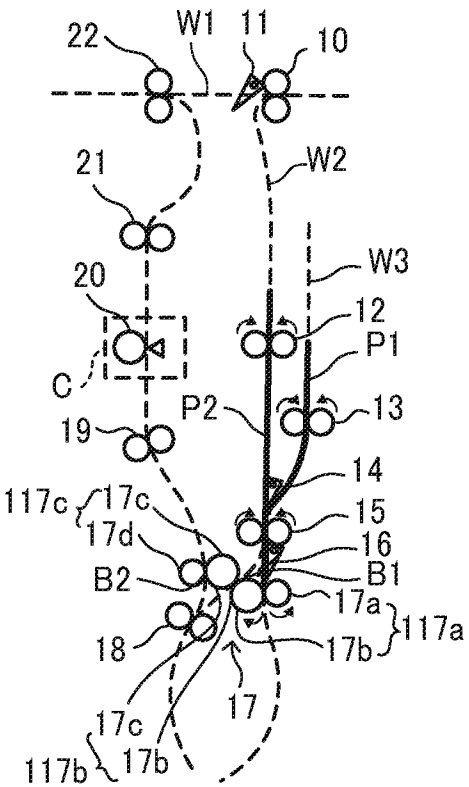
Figure 6F:
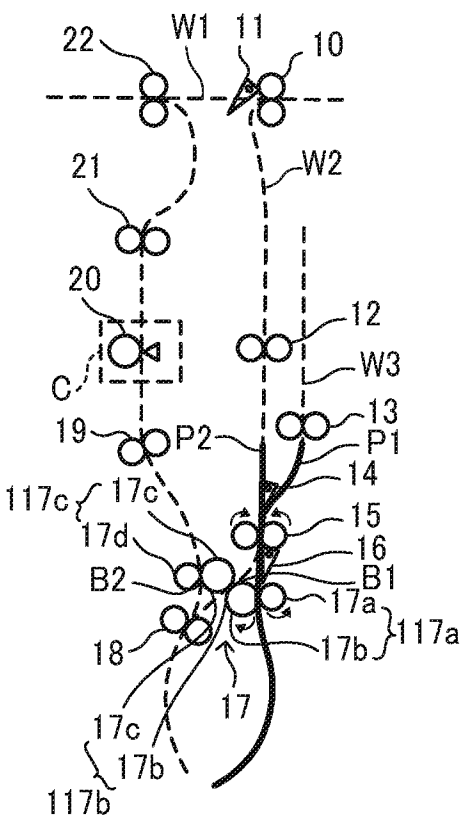

Next, a leading edge of the second sheet P2 contacts the pair of registration rollers 15. As illustrated in FIG. 6D, even after the leading edge of the second sheet P2 contacts the pair of registration rollers 15, the conveyance roller pair 12 continues to convey the second sheet P2 and bends the second sheet P2 to correct the skew of the second sheet P2. As illustrated in FIG. 6E, after a predetermined time in which the second sheet is bent by a predetermined amount has passed, the pair of registration rollers 15, the switchback conveying roller pair 13, and the first conveyance roller pair 117*a* rotate. As illustrated in FIG. 6F, the pair of registration rollers 15 conveys the first sheet P1 and the second sheet P2 in an overlaid manner.

When the number of overlaid sheets reaches the number set by the user, the folding section B starts the folding processing. On the other hand, when the number of overlaid sheets does not reach a number set by the user, the overlaid sheets are conveyed in the reverse direction when the trailing edge of the overlaid sheets has passed through the second bifurcating claw 14 and evacuates to the switchback conveyance path W3. The sheets P are overlaid by repeating the above operation according to the number of sheets to be overlaid.

In the present embodiment, as described above, the skew of the second sheet P2 is corrected without stopping the rotation of the conveyance roller pair 12, and the pair of registration rollers 15 starts to rotate when the bending amount of the second sheet P2 reaches the predetermined amount. Therefore, it is possible to overlay the preceding first sheet and the following second sheet without reducing the productivity.

While the number of the overlaid sheets does not reach the number set by the user, an overlay process without the skew correction by the pair of registration rollers 15 may be performed, and, when the number of the overlaid sheets reaches the number set by the user, the overlay process with the skew correction by the pair of registration rollers 15 may be performed. In the overlay process with the skew correction, the switchback conveying roller pair 13 strikes the leading edge of the preceding sheet P1 or a preceding sheet bundle against the pair of registration rollers 15 to correct the skew and puts the sheet P1 or the preceding sheet bundle on standby, and, after the conveyance roller pair 12 strikes the leading edge of the second sheet P2 against the pair of registration rollers 15 to correct the skew, the pair of registration rollers 15 conveys the overlaid sheets. On the other hand, in the overlay process without the skew correction, the leading edge of the preceding sheet P1 or the sheet bundle is placed in the switchback conveyance path W3 and put on standby. Then, the switchback conveying roller pair 13 starts to convey the preceding sheet P1 or the preceding sheet bundle so that the preceding sheet P1 or the preceding sheet bundle placed on the switchback conveyance path W3 reaches the pair of registration rollers 15 when the following sheet P2 reaches the pair of registration rollers 15, and the sheets are overlaid. The pair of registration rollers 15 conveys the overlaid sheets.

FIGS. 7A to 7D are explanatory diagrams illustrating the general operation when the folding section B performs the Z-folding processing.

The leading edge of the sheet bundle Pt conveyed by the pair of registration rollers 15 after the overlay process enters the first conveyance roller pair 117*a* including the first folding roller 17*b* and the first pressing roller 17*a*. Next, when the sheet bundle Pt is conveyed by a predetermined conveyance amount Δ1, a drive motor to drive the folding mechanism 17 reversely rotates. A travel distance at this time is appropriately determined depending on the length of the sheet bundle Pt in the sheet conveyance direction and the content of the folding processing, such as the manner of folding.

Figure 7A:
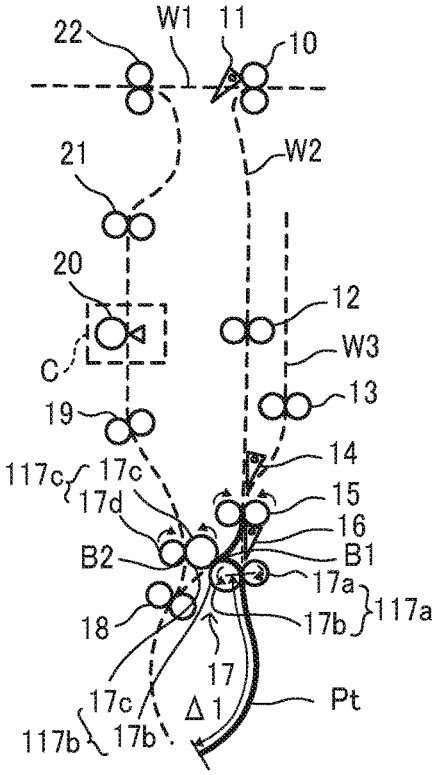
FIGS. 7A to 7D are explanatory diagrams illustrating a general operation when a folding section performs Z-folding processing.

Reverse rotation of the drive motor to drive the folding mechanism 17 conveys the sheet bundle Pt sandwiched by the first conveyance roller pair 117*a* in the reverse direction, that is, the opposite direction to the predetermined direction. This forms a bend in the sheet bundle portion between the pair of registration rollers 15 and the first conveyance roller pair 117*a* as illustrated in FIG. 7A. This bent portion, which is also called a folded-back portion, enters a nip between a first folding roller pair 117*b* including the first folding roller 17*b* and the second folding roller 17*c*, which forms the first folded portion in the folded-back portion. The first folded portion passing through the nip of the first folding roller 17*b* is conveyed toward the second conveyance roller pair 18 serving as a second conveyance member.

The first folded portion in the sheet bundle Pt enters the nip between the second conveyance roller pair 18, and when the sheet bundle Pt is conveyed by the predetermined conveyance amount Δ2, the second conveyance roller pair 18 reversely rotates and conveys the sheet bundle Pt sandwiched by the second conveyance roller pair 18 in the reverse direction that is the opposite direction to the predetermined direction. The conveyance amount Δ2 is appropriately determined depending on the length of the sheet bundle Pt in the sheet conveyance direction and a content of the folding processing such as folding manner.

Figure 7B:
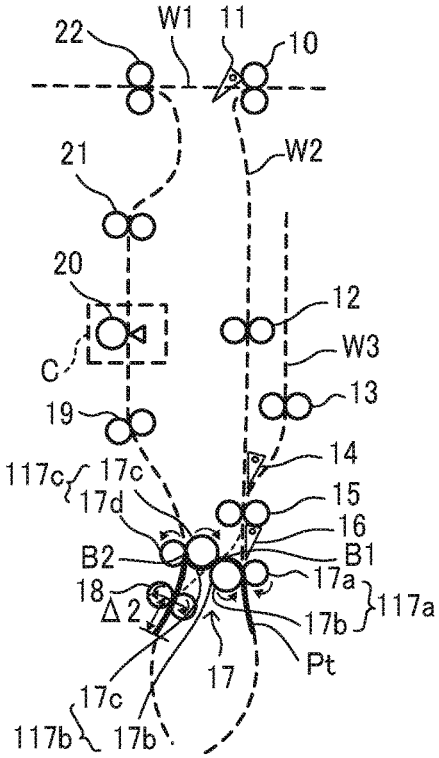

The conveyance of the sheet bundle Pt sandwiched by the second conveyance roller pair 18 in the reverse direction forms a bend in the sheet bundle between the first folding roller pair 117*b* and the second conveyance roller pair 18. As illustrated in FIG. 7B, this bent portion, which is also called a folded-back portion, enters a nip between a second folding roller pair 117*c* including the second folding roller 17*c* and the second pressing roller 17*d*, which forms the second folded portion in the folded-back portion.

Figure 7C:
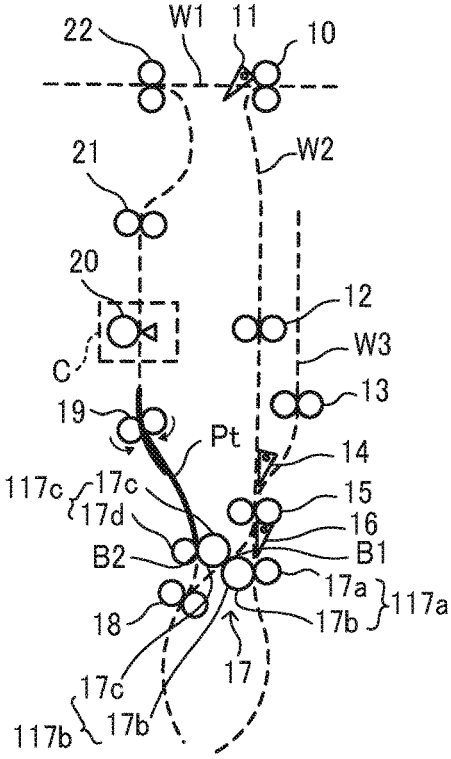
Figure 7D:
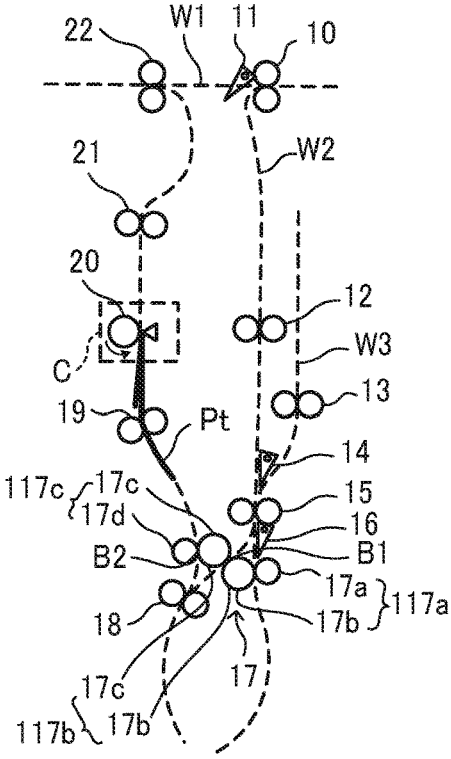

As illustrated in FIG. 7C, an intermediate conveyance roller pair 19 conveys the sheet bundle Pt including the two folded portion formed as described above and having passed through the nip of the second folding roller pair 117*c* toward the additional folding roller 20. As illustrated in FIG. 7D, when the second folded portion reaches the position opposed to the additional folding roller 20, the conveyance of the sheet bundle Pt is stopped. Next, the additional folding roller 20 rotates to put a sharp crease at the second folded portion, and the conveyance of the sheet bundle Pt is resumed. When the first folding portion reaches the position opposed to the additional folding roller 20, the conveyance of the sheet bundle Pt is stopped. The additional folding roller 20 rotates to put a sharp crease at the first folded portion, and the conveyance of the sheet bundle Pt is resumed. Two conveyance roller pairs 21 and 22 convey the sheet bundle Pt, and the conveyance roller pair 22 ejects the sheet bundle Pt to the post-processing apparatus 2.

In the above description, the sheet bundle Pt after the overlay process is folded. The folding processing operation to fold one sheet is the same. In the above description, Z folding-processing is described. The same operation as the Z-folding processing in which the conveyance amount Δ1 and the conveyance amount Δ2 are appropriately changed enables to carry out the inner three-fold and the outer three-fold. In double folding processing, the third bifurcating claw 16 pivots in the clockwise direction in FIGS. 7A to 7D to adopt a posture for guiding the sheet to the first folding roller pair 117*b*, and the sheet conveyed from the pair of registration rollers 15 is conveyed to the first folding roller pair 117*b*. Then, the same operation as the above-described operation to form the second folded portion forms the folded portion at the center of the sheet in the conveyance direction, which enables double folding.

Figure 8:
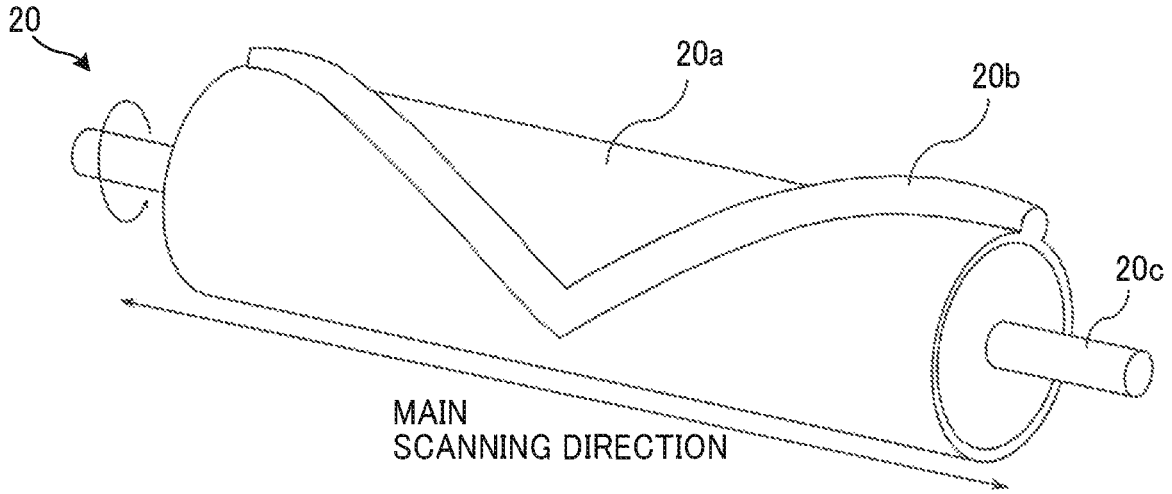
FIG. 8 is a perspective view of an additional folding roller.

FIG. 8 is a perspective view of the additional folding roller 20.

The additional folding roller 20 includes a convex shaped pressing portion 20*b* disposed on a circumferential surface of a pressing roller portion 20*a* with a certain angle difference from a rotation shaft 20*c* of the additional folding roller 20. The pressing portion 20*b* has a V shape symmetrical about the center in the main scanning direction of the additional folding roller 20. This configuration of the additional folding roller 20 according to the present embodiment causes the pressing portion 20*b* to contact the folded portion of the sheet in two places at the same time. The pressing portion 20*b* is disposed in an area not more than half of the circumferential surface of the pressing roller portion 20*a* in the rotation direction.

In the above-described configuration of the pressing portion 20*b*, when the additional folding roller 20 is driven to rotate, the pressing portion 20*b* of the additional folding roller 20 continuously presses the folded portion of the sheet P from the center of the sheet to the both ends of the sheet in the main scanning direction. This avoids the dispersion of the pressing force over the entire area of the folded portion in the main scanning direction in additional folding processing, and the pressing portion 20*b* can intensively apply the pressing force over the entire folded portion of the sheet. Therefore, even when the load applied to the additional folding roller is small, the pressing portion 20*b* can apply a desired pressing force to the folded portion of the sheet, and the load on the additional folding roller 20 of the above-described pressing portion 20*b* in the additional folding processing can be set smaller than the load of the pressing portion pressing the entire area of the folded portion of the sheet in the main scanning direction.

The above described additional folding processing can continuously press the folded portion of the sheet in the main scanning direction in a shorter time than additional folding processing in which a pressing roller moves from one end to the other end on the sheet in the main scanning direction and continuously presses the folded portion of the sheet in the main scanning direction. Therefore, the above described additional folding processing can improve productivity and apply enough pressing force to the folded portion of the sheet.

FIGS. 9A to 9F are explanatory diagrams illustrating a general operation when the additional folding section C performs the additional folding processing.

Figure 9A:
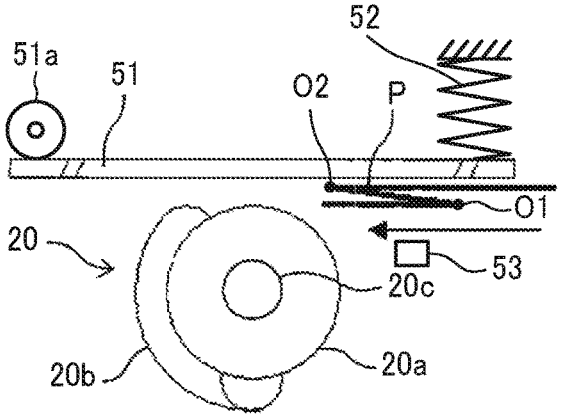
FIGS. 9A to 9F are explanatory diagrams illustrating a general operation when an additional folding section performs additional folding processing.

As illustrated in FIG. 9A, the additional folding section C includes a guide plate 51 opposite the additional folding roller 20 and a spring 52 to press the guide plate 51 toward the additional folding roller 20. The guide plate 51 is rotatably supported by a fulcrum 51*a* downstream in the sheet conveyance direction as a fulcrum, and the spring 52 contacts the upstream end portion of the guide plate 51 in the sheet conveyance direction.

Figure 9B:
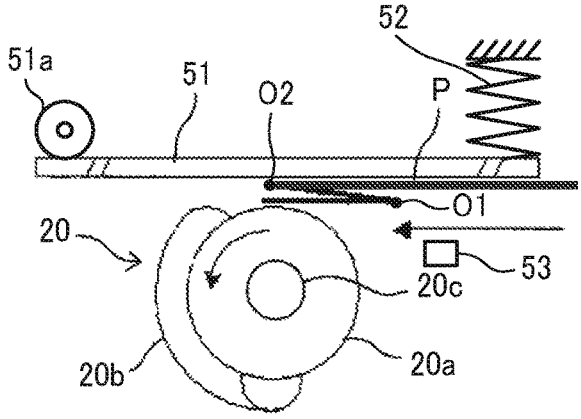

As illustrated in FIG. 9A, in the additional folding roller 20 on standby, a portion in which the pressing portion 20*b* is not formed faces the guide plate 51, and a gap is formed between the additional folding roller 20 and the guide plate 51. When the folded portion of the sheet P downstream in the sheet conveyance direction of the first folded portion O1 and the second folded portion O2 of the sheet P folded by the folding section B (that is, the second folded portion O2 in this example) reaches an additional folding position that is the nearest position to the rotation shaft 20*c* of the additional folding roller 20, the conveyance of the sheet P is temporarily stopped as illustrated in FIG. 9B. As illustrated in FIGS. 9A to 9F, a sheet sensor 53 is disposed in front of the additional folding section C. When a predetermined time passes after the sheet sensor 53 detects the leading edge of the sheet P, the CPU 41 temporarily stops rotation of the conveyance roller pair such as the intermediate conveyance roller pair 19 that sandwiches and conveys the sheet P.

Figure 9C:
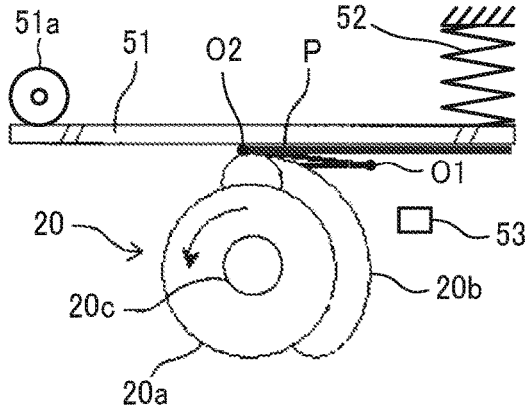

Next, the second motor controller 46 controls the additional folding motor 49 to start rotary drive of the additional folding roller 20. As a result, the second folded portion O2 of the sheet P is continuously pressed in both directions from the center in the main scanning direction in such a manner that the second folded portion O2 is sandwiched between the pressing portion 20*b* of the additional folding roller 20 and the guide plate 51 to put a sharp crease at the second folded portion O2 as illustrated in FIG. 9C.

In this operation example, the additional folding roller 20 starts to rotate after the sheet stops. However, the additional folding roller 20 may start to rotate without waiting for the sheet to stop so that the pressing portion 20*b* of the additional folding roller 20 contacts the folded portion of the sheet when the sheet P stops. The above-described control of the rotation of the additional folding roller 20 shortens the additional folding processing time and improves productivity.

Figure 9D:
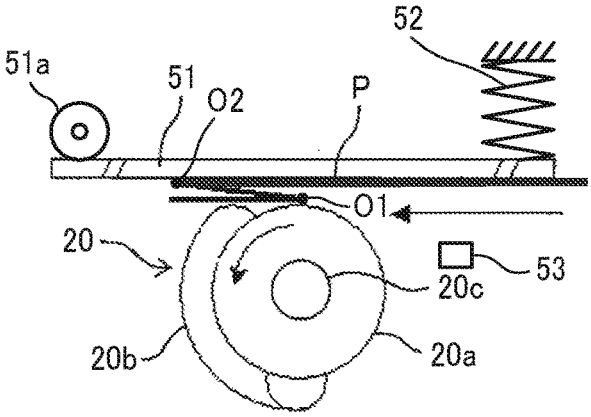

When the additional folding roller 20 is separated from the sheet P, the intermediate conveyance roller pair 19 again conveys the sheet P as illustrated in FIG. 9D. As described above, in the present embodiment, start of the conveyance of the sheet when the additional folding roller 20 is separated from the sheet without waiting stop of rotation of the additional folding roller 20 shortens the additional folding processing time and improves productivity.

Figure 9E:
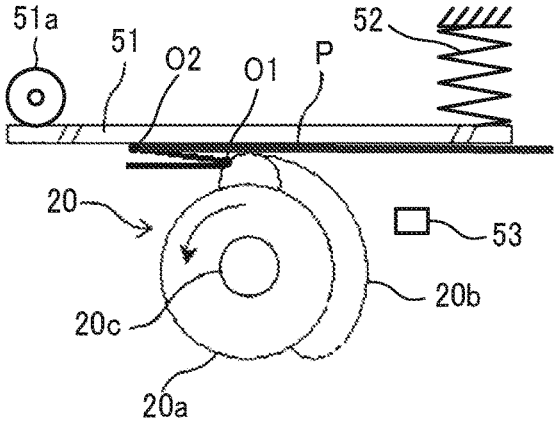
Figure 9F:
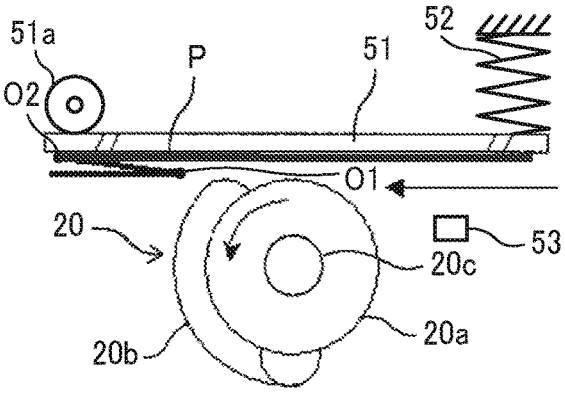

As illustrated in FIG. 9E, when the first folded portion O1 of the sheet P reaches the additional folding position, the intermediate conveyance roller pair 19 temporarily stops the conveyance of the sheet P, and the pressing portion 20*b* of the additional folding roller 20 continuously presses the first folded portion O1 of the sheet P from the center in the main scanning direction to the both ends in the main scanning direction. As illustrated in FIG. 9F, the intermediate conveyance roller pair 19 conveys the sheet P when the additional folding roller 20 separates from the sheet P. The above series of operations is the basic operation of the additional folding operation on the folded portion of the sheet P by the additional folding section C in the present embodiment.

Figure 10A:
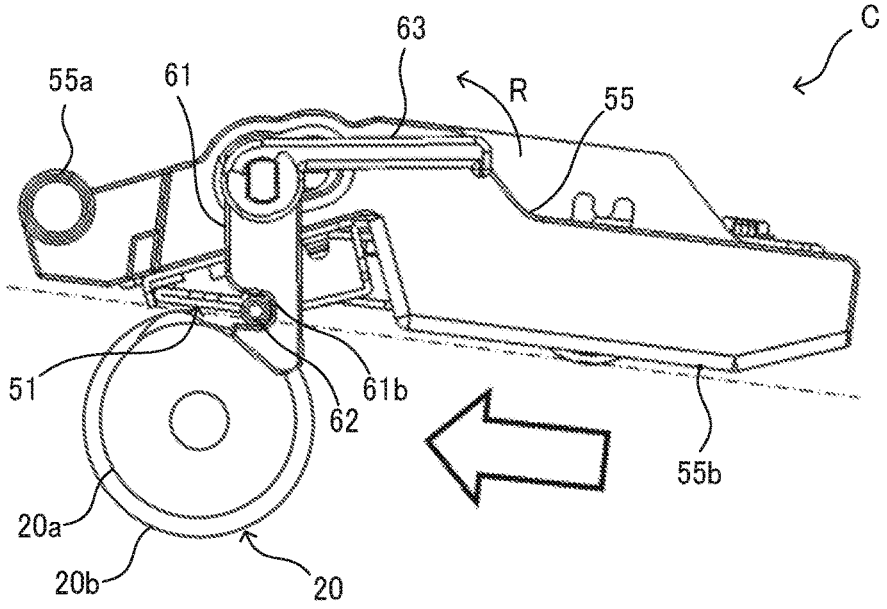
FIGS. 10A and 10B are explanatory diagrams illustrating an operation to remove the jammed sheet in an additional folding section C.
Figure 10B:
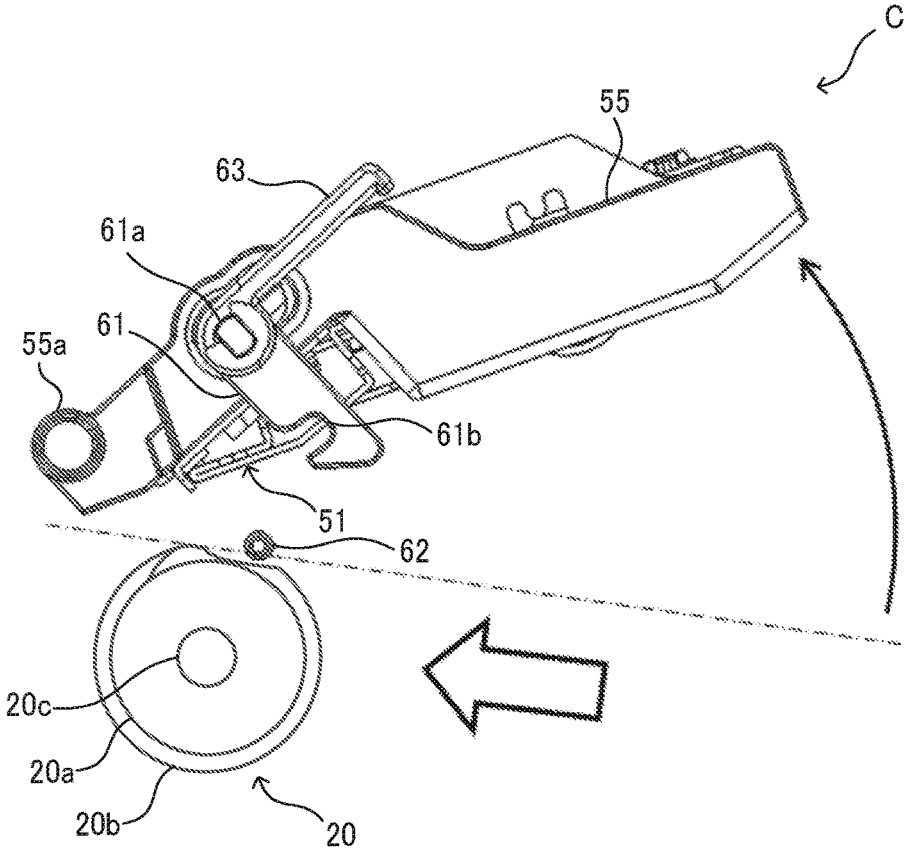

FIGS. 10A and 10B are explanatory diagrams illustrating an operation to remove the jammed sheet in the additional folding section C.

The additional folding section C includes a guide retracting member 55 as a moving member to move the guide plate 51 from a contact position in which the guide plate 51 contacts the pressing portion 20*b* of the additional folding roller 20 to a retracted position in which the guide plate 51 is away from the additional folding roller 20. The guide plate 51 is rotatably attached to the guide retracting member 55 via a single component which is a sheet metal member to fix the spring 52 applying the pressing force to the guide plate 51. A support shaft 55*a* rotatably supports the downstream end portion, which is the left end portion in FIGS. 10A and 10B, of the guide retracting member 55 in the sheet conveyance direction. In addition, the additional folding section C includes a guide 55*b* upstream from the additional folding position in the sheet conveyance direction on the guide retracting member 55 to guide the sheet P to the additional folding position.

A lock 61 is attached to the guide retracting member 55 so as to be rotatable by a predetermined angle. The lock 61 locks the guide retracting member 55 to position the guide plate 51 at the contact position. In addition, a lever 63 which rotates together with the lock 61 by the predetermined angle is attached coaxially with the lock 61. The lock 61 has a hook 61*b*. As illustrated in FIG. 10A, hooking the hook 61*b* on a caulking pin 62 provided on the side plate of the folding apparatus locks the guide retracting member 55 to position the guide plate 51 at the contact position. As a result, the guide plate 51 is locked at the contact position.

When a user removes the jammed sheet, the user rotates the lever 63 by a predetermined angle in a direction of the arrow R in FIG. 10A to disengage the hook 61*b* from the caulking pin 62. Operation of the lever 63 toward the upper side in FIGS. 10A and 10B which is the side away from the additional folding roller after the rotation of the lever by the predetermined angle rotates the guide retracting member 55 counterclockwise around the support shaft 55*a* as a fulcrum. This operation moves the guide plate 51 held by the guide retracting member 55 from the contact position to the retracted position illustrated in FIG. 10B. As a result, a gap between the additional folding roller 20 and the guide plate 51 opens wide, and the user can easily remove the jammed sheet.

After the user removes the jammed sheet, the user rotates the guide retracting member 55 clockwise around the support shaft 55*a* as a fulcrum to move the guide plate 51 from the retracted position to the contact position, hook the hook 61*b* of the lock 61 on the caulking pin 62, and lock the guide plate 51 at the contact position.

Figure 11A:
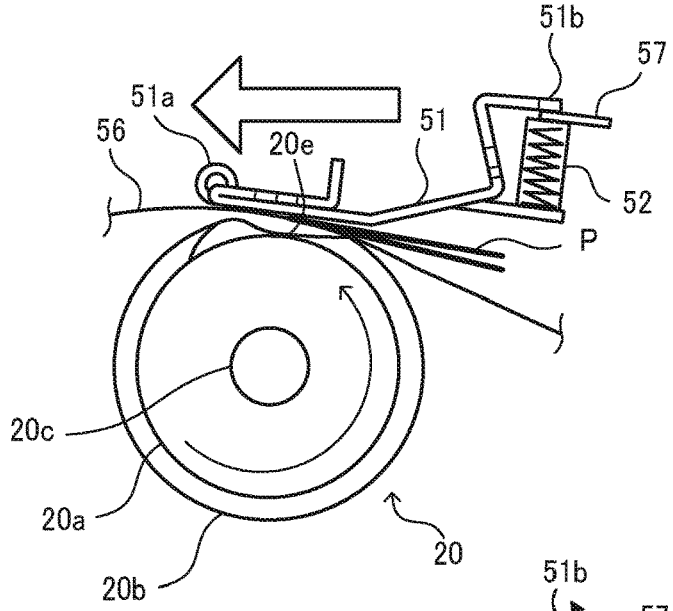
FIGS. 11A to 11C are explanatory diagrams illustrating a mechanism of noise generation during additional folding operation.
Figure 11B:
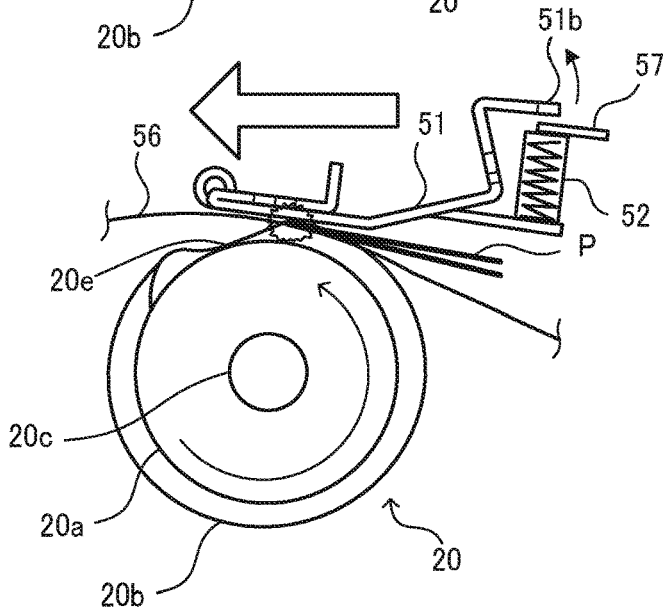
Figure 11C:
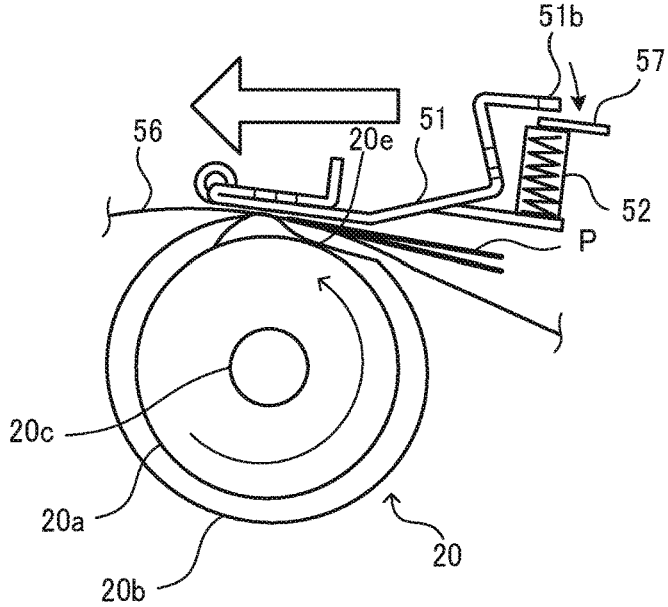

An impact sound sometimes occurs during the additional folding operation. FIGS. 11A to 11C are explanatory diagrams illustrating a mechanism of the impact sound generation during additional folding operation.

As illustrated in FIG. 11A, the additional folding roller 20 on standby stops, and a non-pressing portion 20*e* in which the pressing portion 20*b* is not formed on the additional folding roller 20 is opposed to the guide plate 51. An abutment 51*b* of the guide plate 51 on standby contacts a stopper 57 provided on the guide retracting member 55 and stops a movement of the guide plate 51 toward the additional folding roller due to a biasing force of the spring 52. As a result, a predetermined gap is formed between the guide plate 51 and the additional folding roller 20. Therefore, the sheet can pass through the gap.

Additionally, a film 56 is disposed between the additional folding roller 20 and the guide plate 51. The film 56 is made of a member having a friction coefficient lower than that of the sheet. The end of the film 56 on a right side in FIGS. 11A to 11C that is a side opposite the surface moving direction of the additional folding roller at a position in which the film contacts the guide plate 51 is fixed to the folding apparatus with an adhesive or the like.

If there is no film 56, the pressing portion 20*b* of the rotating additional folding roller 20 is directly pressed against the folded portion of the stopped sheet. The pressing portion 20*b* slides on the sheet in the sheet conveyance direction and presses the folded portion of the sheet. In this case, a frictional force between the sheet and the additional folding roller 20 moves the sheet together with the additional folding roller 20 in the rotation direction of the additional folding roller 20, which shifts the folded portion of the sheet from the additional folding position. This may result in a failure of the additional folding processing.

On the other hand, disposing the film 56 between the additional folding roller 20 and the guide plate 51 causes the additional folding roller 20 to slide on the film 56. Since the film 56 is fixed, no force is applied to the sheet in the rotation direction of the additional folding roller 20. This can prevent the sheet from moving during the additional folding processing and satisfactorily perform the additional folding processing on the folded portion of the sheet.

As illustrated in FIG. 11A, when the folded portion of the sheet reaches the additional folding position, and the sheet is temporarily stopped, the additional folding roller 20 rotates. At this time, the guide plate 51 is closer to the additional folding roller than when the pressing portion 20*b* presses the guide plate 51. Therefore, as illustrated in FIG. 11B, the pressing portion 20*b* of the additional folding roller 20 hits the guide plate 51. The additional folding roller 20 is made of polyacetal (POM) and is generally hard. In addition, the guide plate 51 is made of sheet metal and is also hard. As described above, since hard objects collide with each other, the impact sound is generated immediately after start of the additional folding operation in which the pressing portion 20*b* of the additional folding roller hits the guide plate 51.

After the pressing portion 20*b* hits the guide plate 51, the pressing portion 20*b* presses the guide plate 51 across the folded portion of the sheet. The guide plate 51 rotates counterclockwise in FIG. 11B around the fulcrum 51*a* as a fulcrum against the biasing force of the spring 52. As a result, the abutment 51*b* of the guide plate 51 is away from the stopper 57.

After the abutment 51*b* is away from the stopper 57, the pressing portion 20*b* continuously presses the folded portion of the sheet in the main scanning direction, as illustrated in FIG. 11C, the other end of the pressing portion 20*b* in the rotation direction, that is, both ends of the pressing portion 20*b* in the main scanning direction separate from the sheet, and the non-pressing portion 20*e* of the additional folding roller 20 is opposed to the guide plate 51, thereby completing the additional folding operation. Another impact sound is generated after the other end of the pressing portion 20*b* in the rotation direction, that is, both ends of the pressing portion 20*b* in the main scanning direction separate from the sheet immediately before completing the additional folding operation.

After the other end of the pressing portion 20*b* in the rotation direction, that is, both ends of the pressing portion 20*b* in the main scanning direction separate from the sheet immediately before completing the additional folding operation, nothing presses the guide plate 51. Therefore, the biasing force of the spring 52 rotates the guide plate 51 clockwise in FIGS. 11A to 11C, and the abutment 51*b* of the guide plate 51 hits the stopper 57. As described above, since the abutment 51*b* of the guide plate 51 hits the stopper 57, the impact sound is generated even immediately before completing the additional folding operation.

In order to reduce such impact sounds, in the present embodiment, there is a cam 71 serving as a contact member to press the guide plate 51 when the non-pressing portion 20*e* of the additional folding roller 20 is opposite the guide plate 51, and the cam 71 is provided at both ends of the additional folding roller 20.

Figure 12A:
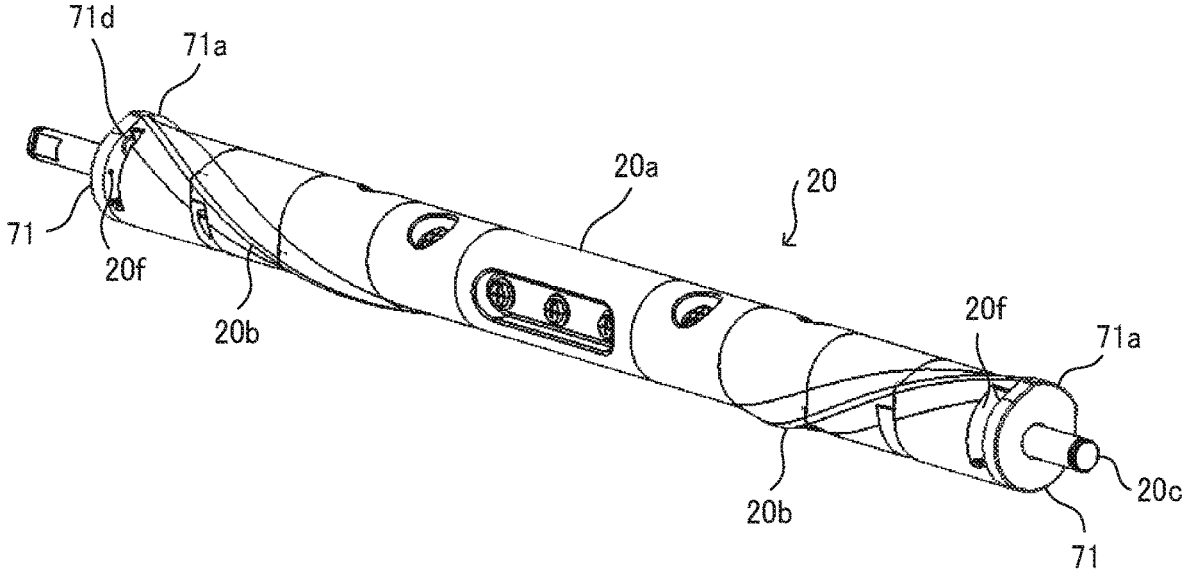
FIGS. 12A to 12C are views illustrating an additional folding roller in the image forming system of FIG. 1.
Figure 12B:
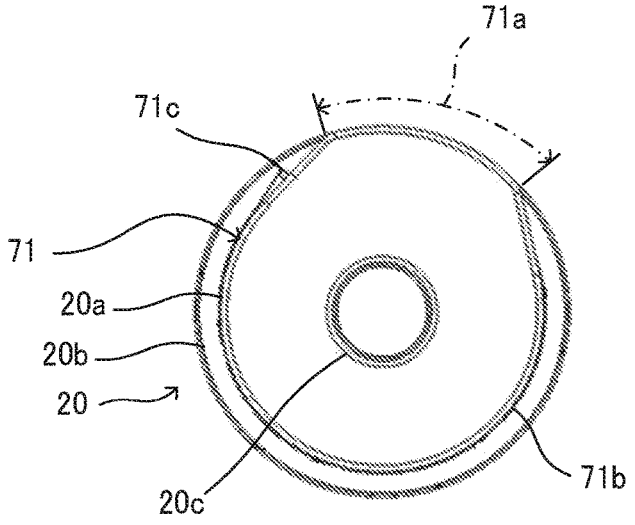
Figure 12C:
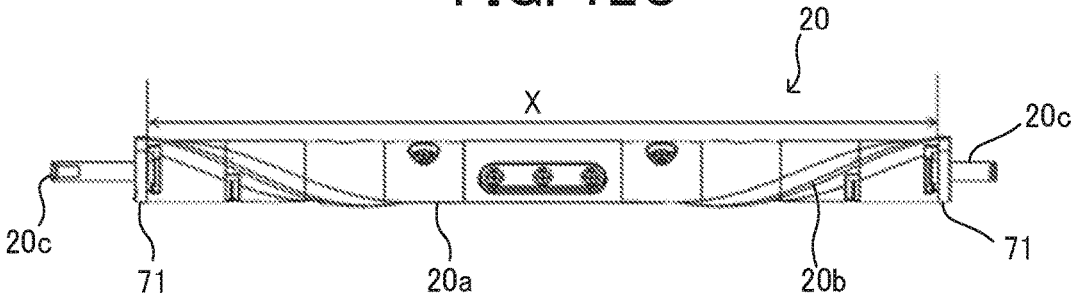

FIGS. 12A to 12C are views illustrating an additional folding roller 20 in the present embodiment, FIG. 12A is a perspective view, FIG. 12B is a side view seen from an axial direction, and FIG. 12C is a front view seen from the sheet conveyance direction.

As illustrated in FIGS. 12A to 12C, the cam 71 serving as the contact member is provided at both ends of the additional folding roller 20. As illustrated in FIG. 12C, the cam 71 at both ends of the additional folding roller 20 are arranged outside the sheet conveyance span X in the folding apparatus 1.

As illustrated in FIG. 12B, the cam 71 has a contact part 71*a* positioned corresponding to the non-pressing portion 20*e* of the additional folding roller 20 to contact the guide plate 51, a non-contact part 71*b* positioned corresponding to the pressing portion 20*b* of the additional folding roller 20, and a connecting part 71*c* connecting the contact part 71*a* and the non-contact part 71*b*.

Figure 13A:
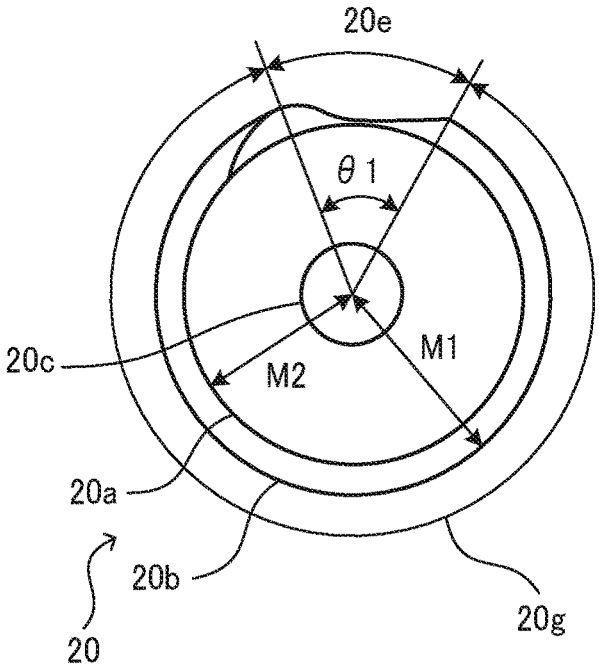
FIGS. 13A and 13B are explanatory diagrams illustrating a dimensional relation between the additional folding roller and a cam.
Figure 13B:
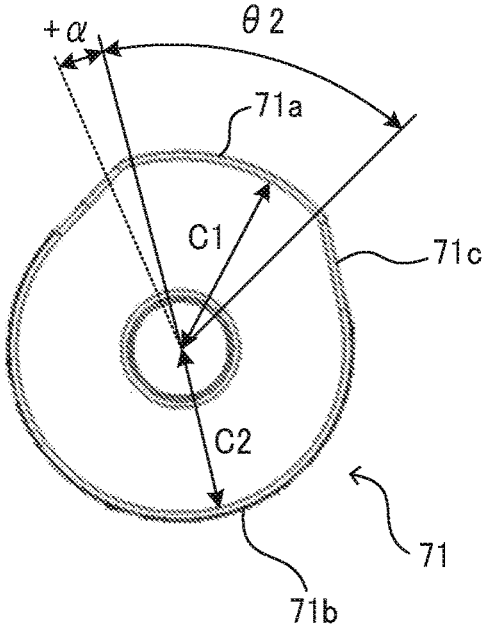

FIGS. 13A and 13B are explanatory diagrams illustrating a dimensional relation between the additional folding roller 20 and the cam 71.

An outer diameter M1 of the pressing portion 20*b* of the additional folding roller 20 is equal to an outer diameter C1 of the contact part 71*a* of the cam 71. This prevents the guide plate 51 from hitting the pressing portion 20*b* and the contact part 71*a* of the cam when the object to be contacted by the guide plate 51 is switched to either the cam 71 or the pressing portion 20*b*, which prevents the generation of the impact sound.

An outer diameter M2 of the pressing roller portion 20*a* of the additional folding roller 20 is also equal to an outer diameter C2 of the non-contact part 71*b* of the cam 71. The outer diameter C2 of the non-contact part 71*b* of the cam 71 may be smaller than the outer diameter M1 of the pressing portion 20*b* of the additional folding roller 20. Additionally, a shape of the connecting part 71*c* of the cam 71 is a tangent extending from the non-contact part 71*b*. A distance between the connecting part 71*c* and the rotation shaft 20*c* may be less than the outer diameter M1 of the pressing portion 20*b*. A shape of the connecting part 71*c* is not limited to a linear shape and may be a curved shape.

A range θ2 of the contact part 71*a* of the cam 71, which is a length of the contact part 71*a* in a circumferential direction of the contact part 71*a*, is the same as a range θ1 of the non-pressing portion 20*e* of the additional folding roller 20, which is a length of the non-pressing portion 20*e* in a circumferential direction of the non-pressing portion 20*e*.

If the range θ2 of the contact part 71*a* of the cam 71 is narrower than the range θ1 of the non-pressing portion 20*e* of the additional folding roller 20, the pressing portion 20*b* may hit the guide plate 51, or the abutment 51*b* of the guide plate 51 may hit the stopper 57, which may cause the impact sound.

On the other hand, if the range θ2 of the contact part 71*a* of the cam 71 is wider than the range θ1 of the non-pressing portion 20*e* of the additional folding roller 20, a following problem may occur. When the range θ2 of the contact part 71*a* of the cam 71 is wider than the range θ1 of the non-pressing portion 20*e* of the additional folding roller 20, a part of the contact part 71*a* of the cam 71 overlaps with the pressing portion 20*b* at the center in the main scanning direction and one end in the rotation direction of the additional folding roller 20 which is the right end portion of the pressing portion 20*b* in FIG. 13A or the pressing portion 20*b* at the center in the main scanning direction and the other end in the rotation direction of the additional folding roller 20 which is the left end portion of the pressing portion 20*b* in FIG. 13A.

When a part of the contact part 71*a* of the cam 71 overlaps with the pressing portion 20*b* at the center in the main scanning direction and one end in the rotation direction of the additional folding roller 20 which is the right end portion of the pressing portion 20*b* in FIG. 13A, contact between the guide plate 51 and the cam 71 disposed both ends of the additional folding roller 20 in the main scanning direction weakens the pressing force of the pressing portion 20*b* that presses a center of the folded portion of the sheet in the main scanning direction. As a result, the center of the folded portion of the sheet in the main scanning direction may not satisfactorily put a sharp crease in the sheet. Similarly, when a part of the contact part 71*a* of the cam 71 overlaps with the pressing portion 20*b* at the center in the main scanning direction and the other end in the rotation direction of the additional folding roller 20 which is the left end portion of the pressing portion 20*b* in FIG. 13A, both ends of the folded portion of the sheet in the main scanning direction may not satisfactorily put the sharp crease. As described above, when a part of the contact part 71*a* of the cam 71 overlaps with the pressing portion 20*b*, the folded portion of the sheet may not satisfactorily put the sharp crease.

Therefore, it is preferable that the range θ2 of the contact part 71*a* of the cam 71 is equal to the range θ1 of the non-pressing portion 20*e* of the additional folding roller 20.

When the pressing roller portion 20*a* of the additional folding roller 20 is longer than the sheet conveyance span and both ends of the pressing portion 20*b* do not contact the folded portion of the sheet, as illustrated by +a in FIG. 13B, the range θ2 of the contact part 71*a* of the cam 71 may be extended to the left side in FIG. 13B so that the part of the contact part 71*a* of the cam 71 overlaps with both ends of the pressing portion 20*b*. The pressing portion may be extended straight in the rotation direction from the center of the pressing portion 20*b* in the main scanning direction that is the center of the V shape of the pressing portion 20*b* corresponding to one end side in the rotation direction of the additional folding roller 20, and this extended portion and the contact part 71*a* of the cam 71 may overlap. The overlap between the contact part 71*a* and the pressing portion is preferable because the overlap reliably prevents a collision between the guide plate 51 and the pressing portion 20*b* and a collision between the abutment 51*b* of the guide plate 51 and the stopper 57. A range 20*g* in FIG. 13B in which the additional folding roller 20 presses the sheet and the range of the non-pressing portion 20*e* are suitably set based on the configuration of the apparatus.

Figure 14A:
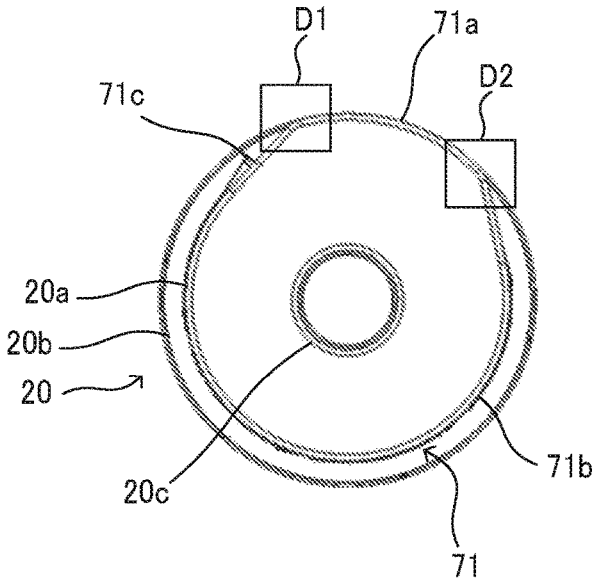
FIGS. 14A to 14C are explanatory diagrams illustrating a shape of a contact part of the cam near position in which a guide plate starts to contact the cam and a shape of the contact part of the cam near position in which the guide plate ends to contact the cam.
Figure 14B:
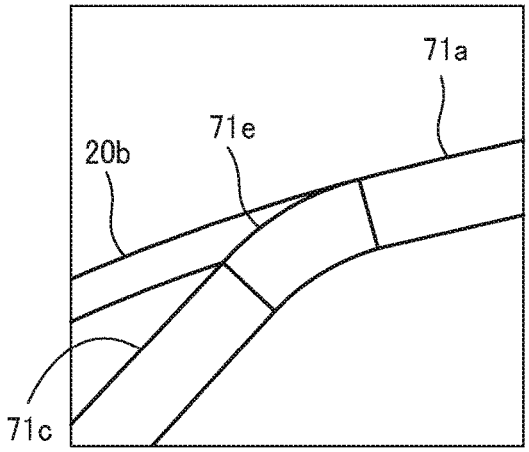
Figure 14C:
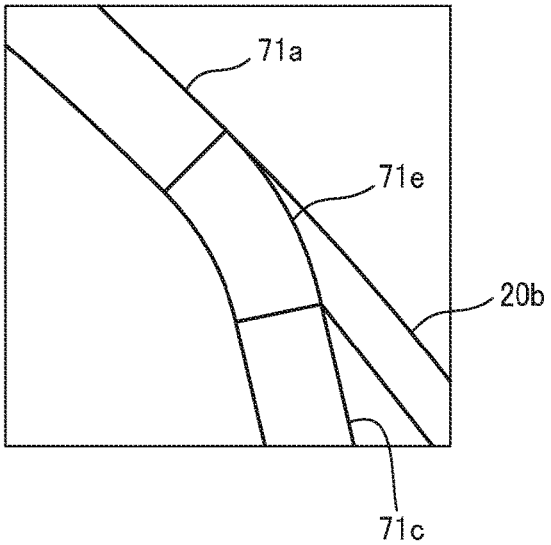

FIGS. 14A to 14C are explanatory diagrams illustrating a shape of the contact part 71*a* of the cam 71 near the position D1 in which the guide plate starts to contact the cam 71 and a shape of the contact part 71*a* of the cam 71 near the position D2 in which the guide plate ends to contact the cam 71.

As illustrated in FIG. 14, a part 71*e* between the connecting part 71*c* and the contact part 71*a* curves. Since the curved part 71*e* described above guides the guide plate and gradually brings the guide plate close to and comes into contact with the pressing portion, the curved part 71*e* prevents the occurrence of the impact sound that occurs when the outer diameter of the contact part 71*a* of the cam 71 is made larger than the outer diameter of the pressing portion, for example, because of a manufacturing error. The part 71*e* between the connecting part 71*c* and the contact part 71*a* may be formed in a linear shape connecting the connecting part 71*c* and the end portion of the contact part 71*a*.

Figure 15A:
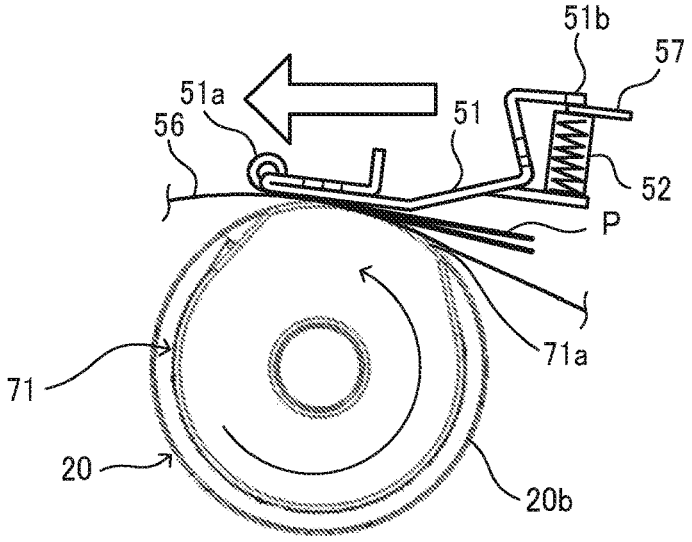
FIGS. 15A to 15C are explanatory diagrams illustrating noise control during the additional folding operation in the image forming system of FIG. 1.
Figure 15B:
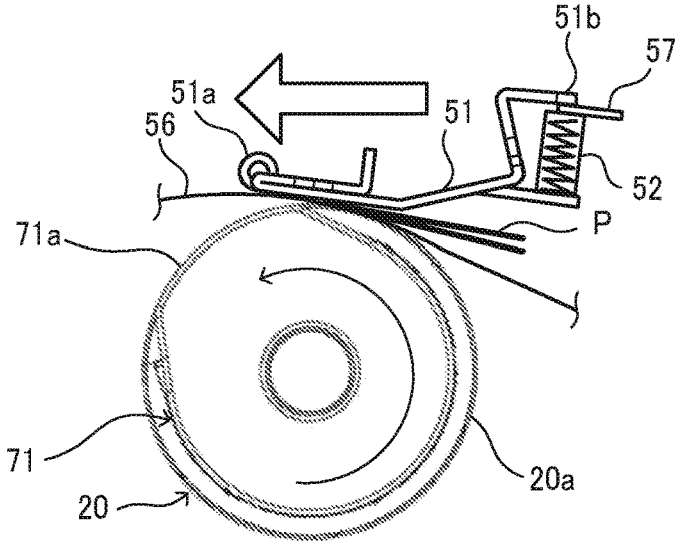
Figure 15C:
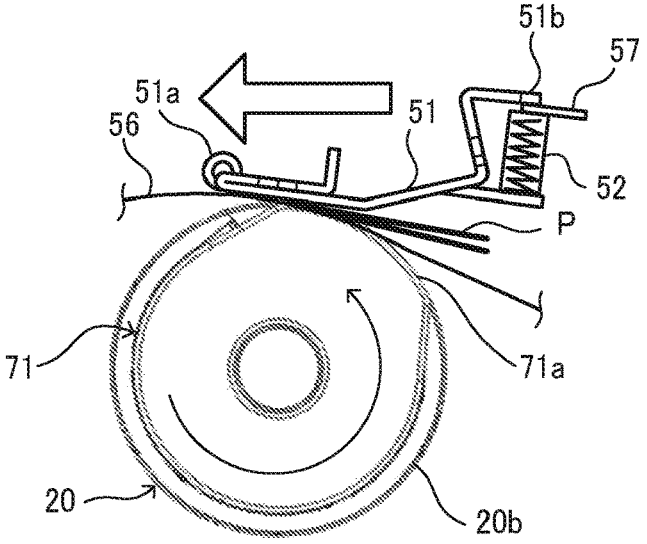

FIGS. 15A to 15C are explanatory diagrams illustrating noise control during the additional folding operation in the image forming system of FIG. 1.

As illustrated in FIG. 15A, when the non-pressing portion 20*e* of the additional folding roller 20 on standby is opposed to the guide plate 51, the contact part 71*a* of the cam 71 contacts the guide plate 51, thereby pressing the guide plate 51. As described above, since the cam 71 is disposed outside the sheet conveyance span, the cam 71 does not obstruct the conveyance of the sheet.

A length of the film 56 in the main scanning direction that is the axial direction of the additional folding roller 20 is the same as the length of the additional folding roller 20, and the film 56 does not contact the cams 71 disposed at ends of the additional folding roller 20 because, if the film 56 contacts the cam 71, the cam 71 pushes the film 56 to the guide plate 51, and the sheet may not pass between the film 56 and the guide plate 51 even when the non-pressing portion 20*e* of the additional folding roller 20 is opposed to the guide plate 51 to pass the sheet. In the present embodiment, the length of the film 56 in the main scanning direction that is the axial direction is set to the same as the length of the additional folding roller 20 so that the film 56 does not contact the cam 71. Or, the film 56 may be longer than the additional folding roller 20 and have a hole opposite the cam 71 so that the cam 71 passes through the hole and does not contact the film 56.

As illustrated in FIG. 15B, when the folded portion of the sheet reaches the additional folding position and the additional folding roller rotates, the contact part 71*a* of the cam 71 separates from the guide plate 51. In the present embodiment, as described above, the range of the contact part 71*a* of the cam 71 is equal to the range of the non-pressing portion 20*e* of the additional folding roller 20. Therefore, immediately after the contact part 71*a* of the cam 71 separates from the guide plate 51, the pressing portion 20*b* contacts the guide plate 51 via the sheet. Since the outer diameter C1 of the contact part 71*a* is equal to the outer diameter M1 of the pressing portion 20*b*, when a member pressing the guide plate is switched from the contact part 71*a* of the cam 71 to the pressing portion 20*b*, the guide plate 51 is not rotated. Therefore, the pressing portion 20*b* does not hit the guide plate 51, and it is possible to prevent the occurrence of the impact sound immediately after the start of the additional folding processing.

As illustrated in FIG. 15C, just before the end of the additional folding processing and immediately after the pressing portion 20*b* separates from the guide plate 51, the contact part 71*a* of the cam 71 contacts the guide plate 51 and presses the guide plate 51. Therefore, the biasing force of the spring 52 does not rotate the guide plate 51, and the abutment 51*b* does not hit against the stopper 57. It is possible to prevent the generation of impact sound immediately before the end of the additional folding processing.

However, in the above-described configuration, the pressing portion 20*b* or the contact part 71*a* of the cam 71 always presses the guide plate 51 at the contact position. Therefore, as illustrated in FIG. 10B, after the user sets the guide plate 51 at the retracted position and removes the jammed sheet, when the user sets the guide plate 51 at the contact position and hooks the hook 61*b* of the lock 61 on the caulking pin 62, the cam 71 or the pressing portion 20*b* presses the guide plate 51 in a direction away from the additional folding roller 20. As a result, unless the guide retracting member 55 is strongly pressed to the additional folding roller, the hook 61*b* of the lock 61 is not caught by the caulking pin 62, which hinders removal of the jammed sheet.

Therefore, in the present embodiment, the cam 71 is configured to be rotatable with respect to the additional folding roller 20 so that the contact part 71*a* of the cam 71 can be retracted from the non-pressing portion 20*e* in the rotation direction.

Figure 16:
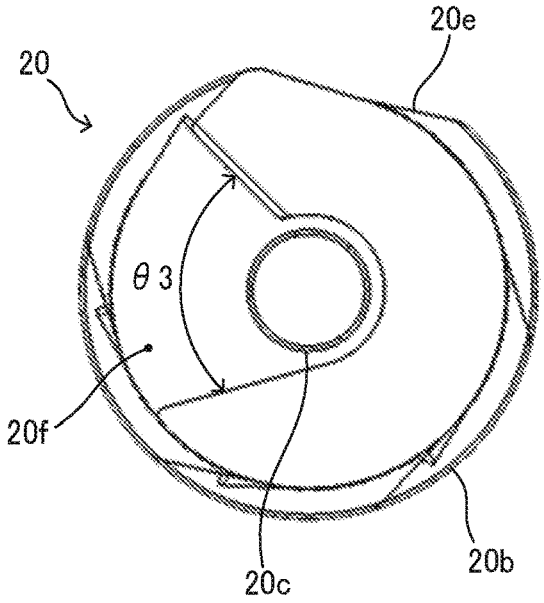
FIG. 16 is a schematic configuration diagram illustrating an end of the additional folding roller.
Figure 17A:
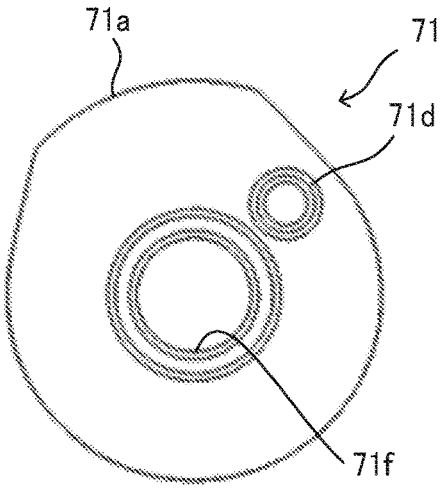
FIG. 17A is a front view of a portion of the cam opposed to the end of the additional folding roller.
Figure 17B:
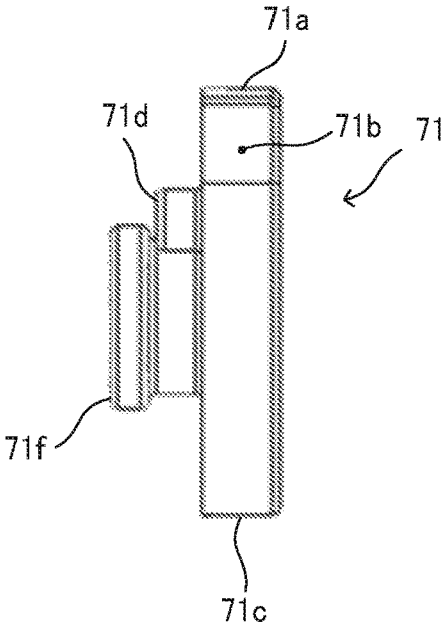
FIG. 17B is a side view of the portion of the cam opposed to the end of the additional folding roller.

FIG. 16 is a schematic configuration diagram illustrating the end of the additional folding roller, FIG. 17A is a front view of a portion of the cam 71 opposed to the end of the additional folding roller 20, and FIG. 17B is a side view of the portion of the cam 71 opposed to the end of the additional folding roller 20.

As illustrated in FIG. 16 and FIG. 12A, cutout portions 20*f* serving as projection receiving portions are formed at both ends of the additional folding roller. A range θ3 of the cutout portion 20*f* in the rotation direction is wider than a sum of a half of the range θ2 of the contact part 71*a* of the cam 71 (see FIG. 13B) and a diameter of a projection 71*d* on the cam 71 (see FIGS. 17A-B).

As illustrated in FIGS. 17A-B, the cam 71 has a support hole 71*f* into which the rotation shaft 20*c* of the additional folding roller 20 is inserted to rotatably support the cam 71 and the projection 71*d* which enters the cutout portion 20*f* so that the additional folding roller 20 and the cam 71 rotate together.

Figure 18A:
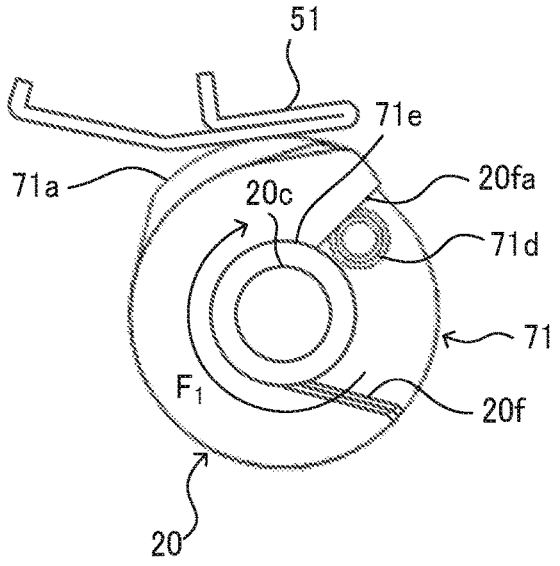
FIGS. 18A and 18B are explanatory diagrams illustrating a relation between the cam and the additional folding roller in the additional folding operation.
Figure 18B:
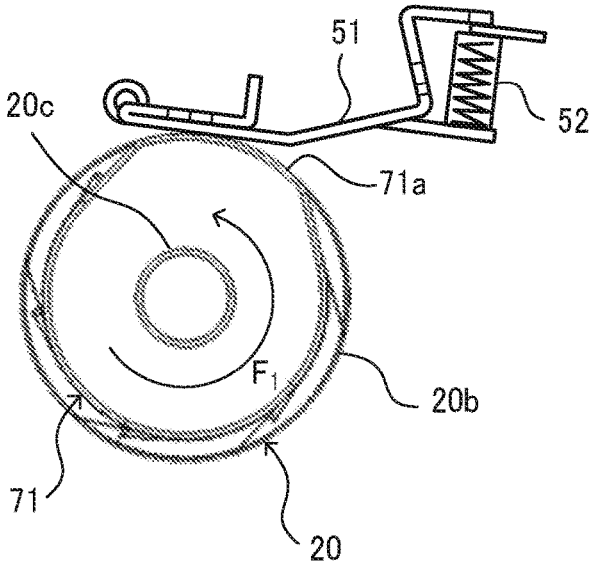

FIGS. 18A and 18B are explanatory diagrams illustrating a relation between the cam 71 and the additional folding roller 20 in the additional folding operation. FIG. 18A is a sectional view of the guide plate 51 and the additional folding roller 20 cut at the cutout portion 20*f* and seen from the center of the additional folding roller 20 in the axial direction, and FIG. 18B is a side view of the guide plate 51, the spring 52, and the additional folding roller 20 seen from the end portion side of the additional folding roller 20.

As illustrated in FIG. 18A, when the additional folding roller 20 rotates forward in a direction of arrow F1 in FIG. 18A to perform the additional folding processing, the projection 71*d* of the cam 71 contacts an end face 20*fa* of the cutout portion 20*f* on the downstream side in the forward rotation direction, and the cam 71 rotates together with the additional folding roller 20. When the projection 71*d* of the cam 71 contacts the end face 20*fa* of the cutout portion 20*f* on the downstream side in the forward rotation direction, the contact part 71*a* of the cam 71 positions the non-pressing portion 20*e* of the additional folding roller 20. Therefore, as described with reference to FIGS. 15A and 15B, generation of the impact sound can be prevented.

FIGS. 19A, 19B, 20A, and 20B are explanatory diagrams illustrating operations when the user removes the jammed sheet.

Figure 19A:
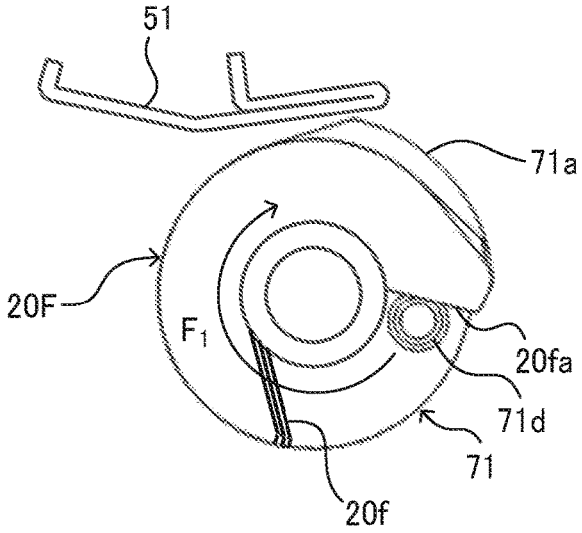
FIGS. 19A and 19B are explanatory diagrams illustrating an operation separating the contact part of the cam from the guide plate to remove the jammed sheet.
Figure 19B:
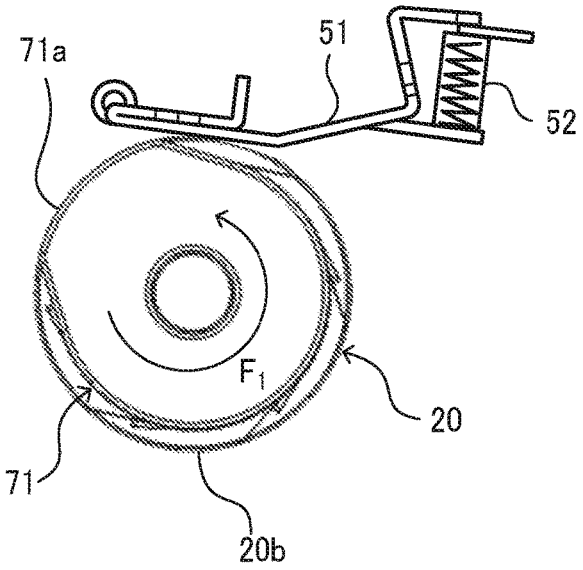
Figure 20A:
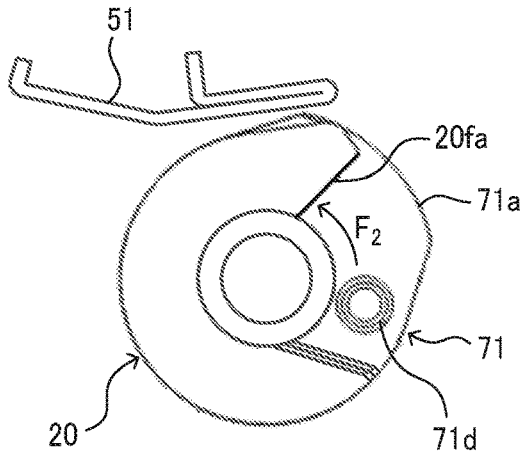
FIGS. 20A and 20B are explanatory diagrams illustrating an operation directing a non-pressing portion of the additional folding roller toward the guide plate during removal of the jammed sheet.
Figure 20B:
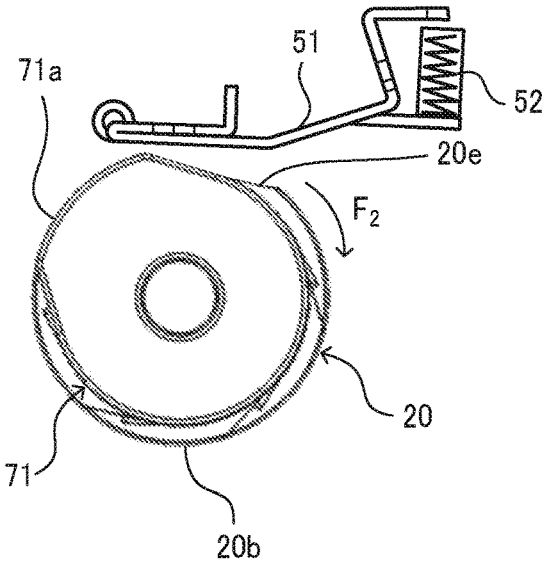

FIGS. 19A and 20A are sectional views of the guide plate 51 and the additional folding roller 20 cut at the cutout portion 20*f* and seen from the center of the additional folding roller 20 in the axial direction, and FIGS. 19B and 20B are side views of the guide plate 51, the spring 52, and the additional folding roller 20 seen from the end portion side of the additional folding roller 20.

When a sheet jam occurs, the additional folding roller 20 rotates forward in the direction of an arrow F1 in FIGS. 19A and 19B. The end face 20*fa* of the cutout portion 20*f* on the downstream side in the forward rotation direction pushes the projection 71*d* of the cam 71, and the cam 71 rotates with the additional folding roller 20 in the direction of the arrow F1. As illustrated in FIGS. 19A and 19B, when the contact part 71*a* of the cam 71 separates from the guide plate 51, the rotation of the additional folding roller 20 temporarily stops.

Next, with reference to FIGS. 20A and 20B, the additional folding roller 20 rotates in reverse, that is, rotates in a direction of arrow F2 in FIGS. 20A and 20B. The cam 71 does not rotate in reverse because the end face 20*fa* does not push the projection 71*d*, and only the additional folding roller 20 rotates in reverse, rotates relative to the cam 71. As illustrated in FIGS. 20A and 20B, the pressing portion 20*b* of the additional folding roller 20 separates from the guide plate 51, and the non-pressing portion 20*e* is opposed to the guide plate 51. As a result, neither the contact part 71*a* nor the pressing portion 20*b* exists opposite the guide plate 51. Such a region is formed opposite the guide plate 51. When the non-pressing portion 20*e* is opposite the guide plate 51 and the guide plate 51 separates from both of the additional folding roller 20 and the cam 71 as illustrated in FIGS. 20A and 20B, the reverse rotation of the additional folding roller 20 stops.

Since the user removes the jammed sheet under the state illustrated in FIGS. 20A and 20B, after the user sets the guide plate 51 at the retracted position and removes the jammed sheet, when the user sets the guide plate 51 at the contact position, the guide plate 51 does not receive the pressing force in the direction away from the additional folding roller 20. Therefore, the user can easily hook the hook 61*b* of the lock 61 on the caulking pin 62 and remove the jammed sheet.

After the user removes the jammed sheet, the additional folding roller 20 rotates in reverse. An end face of the cutout portion 20*f* on the upstream side in the reverse rotation direction pushes the projection 71*d* of the cam 71, the cam 71 reversely rotates together with the additional folding roller 20, and the contact part 71*a* of the cam 71 contacts the guide plate 51. The attitude of the cam 71 returns to the state illustrated in FIGS. 18A and 18B. Next, until the end face 20*fa* of the cutout portion 20*f* on the upstream side in the forward rotation direction contacts the projection 71*d* of the cam 71, the additional folding roller 20 rotates forward and rotates relative to the cam 71. When the end face 20*fa* of the cutout portion 20*f* on the upstream side in the forward rotation direction contacts the projection 71*d* of the cam 71, the forward rotation of the additional folding roller 20 stops, and the non-pressing portion 20*e* of the additional folding roller 20 is opposed to the guide plate 51. The state illustrated in FIGS. 18A and 18B is restored.

After the user removes the jammed sheet, the additional folding roller 20 may rotate forward and, together with the cam 71, rotate forward by substantially one turn so that the contact part 71*a* of the cam 71 contacts the guide plate 51.

In the present embodiment, the projection 71*d* of the cam 71 enters the cutout portion 20*f* disposed at the end of the additional folding roller 20, but the projection 71*d* may enter a groove extending in the rotation direction disposed at the end of the additional folding roller 20.

In the above-described configuration, since the cam 71 is merely rotatably supported by the rotation shaft 20*c* of the additional folding roller 20, the cam 71 may accidentally rotate relative to the additional folding roller 20. When the additional folding roller 20 rotates in reverse as illustrated in FIGS. 20A and 20B, impact or the like may rotate the cam 71 relative to the additional folding roller 20 counterclockwise in FIG. 20A and clockwise in FIG. 20B, and the contact part 71*a* of the cam 71 may move to the contact position where the contact part 71*a* contacts the guide plate 51. As described above, a movement of the contact part 71*a* of the cam 71 to the contact position, where the contact part 71*a* contacts the guide plate 51 after the additional folding roller 20 starts to rotate in reverse, hinders the operation of locking the guide plate 51 after the user removes the jammed sheet.

Therefore, it is preferable that the cam 71 is pressed against the additional folding roller 20 so as not to accidentally rotate relative to the additional folding roller 20.

Figure 21:
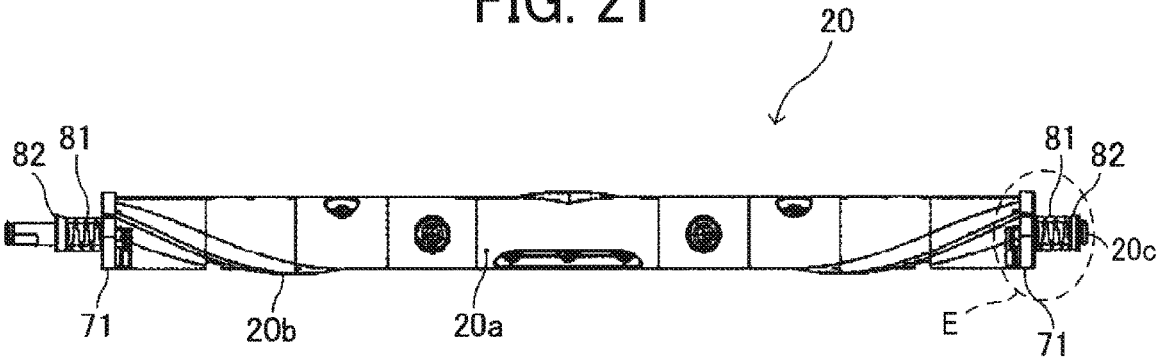
FIG. 21 is a front view illustrating an example of the additional folding roller pressed against the cam.
Figure 22:
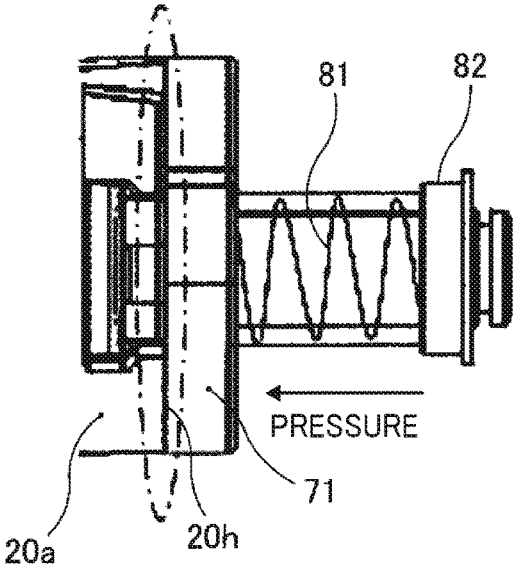
FIG. 22 is an enlarged view of a portion surrounded by a dotted line E in FIG. 21.

FIG. 21 is a front view illustrating an example of the additional folding roller 20 pressed against the cam 71, and FIG. 22 is an enlarged view of a portion surrounded by a dotted line E in FIG. 21.

As illustrated in FIG. 21 and FIG. 22, coil springs 81 serving as pressers and spring receivers 82 are inserted the rotation shaft 20*c* at both end of the additional folding roller 20. One end of the coil spring 81 contacts the spring receiver 82, and the other end contacts the cam 71 to press the cam 71 toward the pressing roller portion 20*a*. As a result, the biasing force of the coil spring 81 presses the cam 71 against an end face 20*h* of the pressing roller portion 20*a* which is a face opposite the cam 71 in the axial direction.

As described above, pressing the cam 71 against the end face 20*h* of the pressing roller portion 20*a* generates a predetermined frictional force between the cam 71 and the end face 20*h* and prevents the accidental rotation of the cam 71 relative to the additional folding roller 20. This prevents the rotation of the cam 71 relative to the additional folding roller 20 caused by an impact or the like that occurs during jam processing to remove the jammed sheet and the movement of the cam 71 to the contact position at which the contact part 71*a* of the cam 71 contacts the guide plate 51. As a result, difficulty in locking the guide plate 51 after the jam processing at the contact position can be reduced.

The frictional force between the cam 71 and the end face 20*h* is set weaker than a force required to push up the guide plate 51 that is the biasing force of the spring 52 to press the guide plate 51 toward the additional folding roller 20. The frictional force between the cam 71 and the end face 20*h* can be controlled by an elastic force of the spring 81 or the surface roughness of the cam 71 and the end face 20*h*.

FIGS. 23A to 23D are explanatory diagrams illustrating an operation when the jammed sheet is removed after the contact part 71*a* of the cam 71 separates from the guide plate 51 in the configuration in which the cam 71 is pressed against the end face 20*h* of the pressing roller portion 20*a*.

Figure 23A:
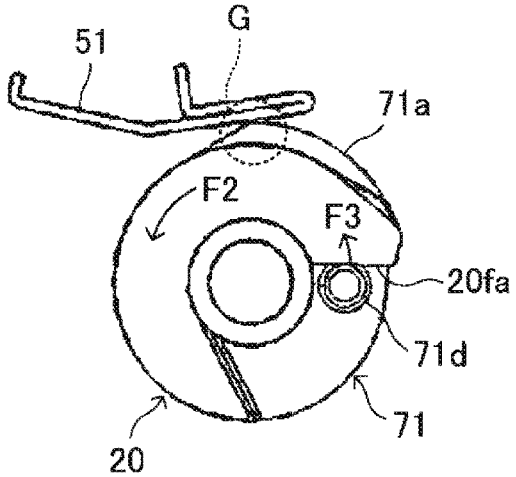
FIGS. 23A to 23D are explanatory diagrams illustrating an operation when the jammed sheet is removed after the contact part of the cam separates from the guide plate in a configuration in which the cam is pressed against the end face of a pressing roller portion.

As illustrated in FIGS. 23A to 23D, after the contact part 71*a* of the cam 71 separates from the guide plate 51, when the additional folding roller 20 rotates in reverse, that is, rotates in a direction of the arrow F2 in FIGS. 23A to 23D, a static friction force between the cam 71 and the end face 20*h* of the pressing roller portion 20*a* causes a reverse rotation of the cam 71 with the additional folding roller 20 in a direction of an arrow F3 in FIG. 23A.

Figure 23B:
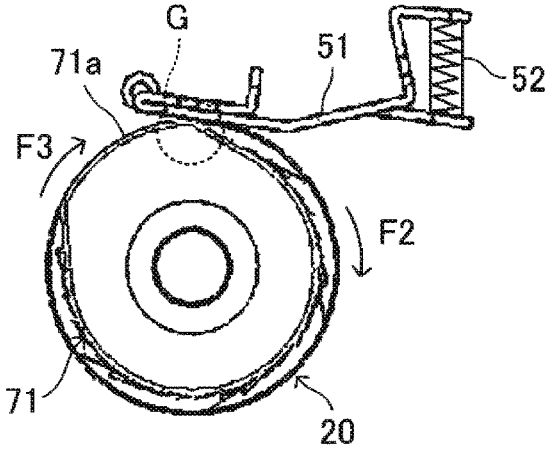

The reverse rotation of the cam 71 with the additional folding roller 20 results in contact between the guide plate 51 and one end of the contact part 71*a* in the reverse rotation direction, as indicated by G in FIGS. 23A and 23B.

Figure 23C:
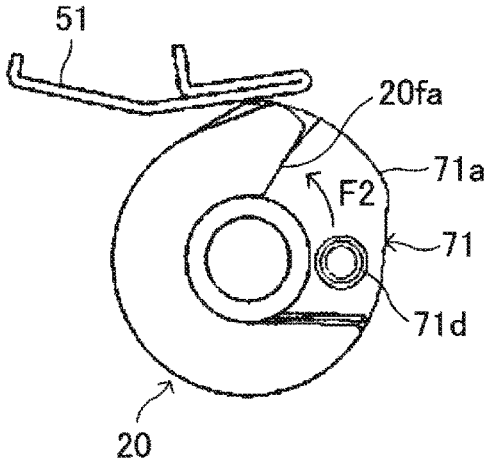
Figure 23D:
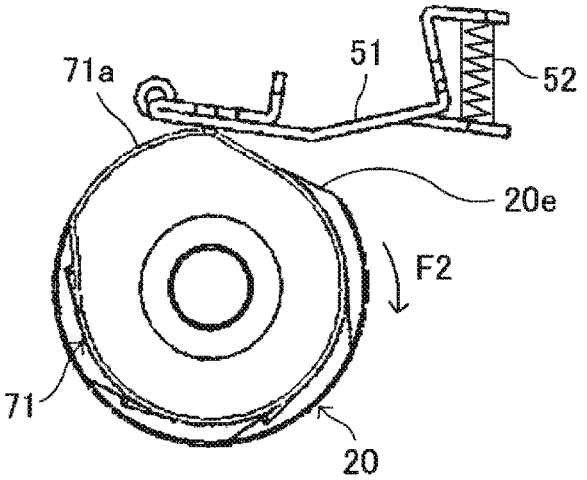

As described above, the static frictional force between the cam 71 and the end face 20*h* is set weaker than the force required to push up the guide plate 51 that is the biasing force of the spring 52. Accordingly, when one end of the contact part 71*a* in the reverse rotation direction contacts the guide plate 51, the reaction force of the guide plate 51 exceeds the static frictional force between the cam 71 and the end face 20*h* and prevents the cam 71 from reversely rotating. As a result, the cam 71 relatively slides on the end face 20*h*, and only the additional folding roller 20 rotates in the reverse direction. As illustrated in FIGS. 23C and 23D, this causes the non-pressing portion 20*e* to be opposite the guide plate 51 and brings about a state in which the contact part 71*a* of the cam 71 disengages from the guide plate 51.

In this example, the contact part 71*a* of the cam 71 contacts the guide plate 51, but, since the contact part 71*a* pushes up the guide plate 51, the work of locking the guide plate 51 at the contact position after the above-described jam processing is not difficult.

In the above description, the coil spring 81 presses the cam 71 in the axial direction against the end face 20*h* opposite the cam 71 in the axial direction, but, for example, a radially opposed surface and the cam may be pushed against each other.

Figure 24:
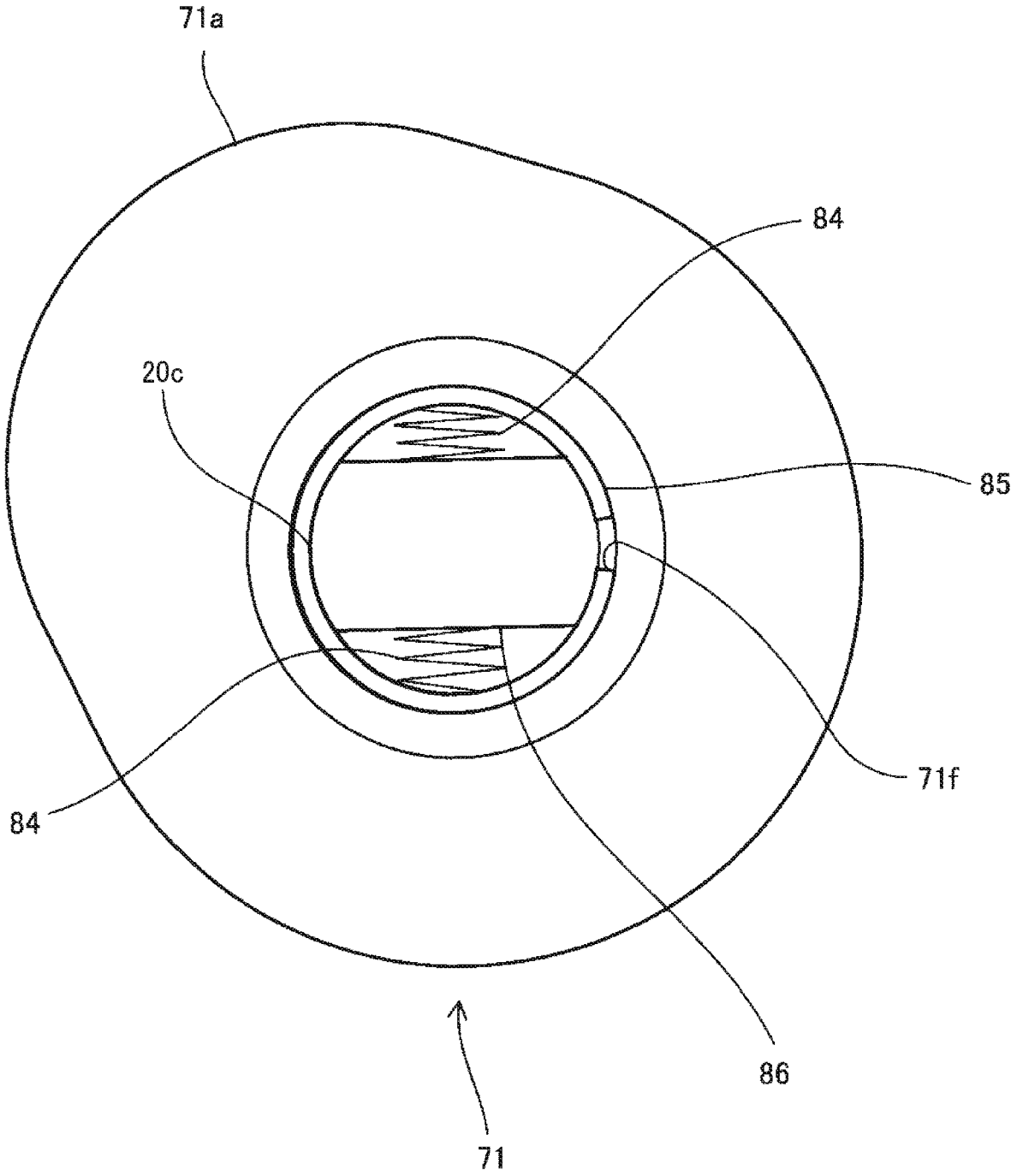
FIG. 24 is an explanatory diagram illustrating an example of a configuration in which a radially opposed surface and the cam press against each other.

FIG. 24 is an explanatory diagram illustrating an example of a configuration in which a radially opposed surface and the cam press against each other.

As illustrated in FIG. 24, a tubular pressing member 85 configured to be capable of enlarging a diameter by being cut out at one part of the tubular pressing member 85 is inserted between a support hole 71*f* of the cam 71 and the rotation shaft 20*c*. The rotation shaft 20*c* has two spring holders 86 provided at intervals of 180 degrees. The spring holder 86 has a flat surface formed by cutting out the rotation shaft 20*c*. Each of two springs 84 is disposed between the flat surface of the spring holder 86 and the tubular pressing member 85 and pushes the tubular pressing member 85 in the radial direction. As a result, forces of the springs 84 enlarge the diameter of the tubular pressing member 85, and an outer circumferential surface of the tubular pressing member 85 serving as the opposing surface presses against the inner circumferential surface of the support hole 71*f* of the cam 71.

With the above-described configuration as well, the frictional force between the outer circumferential surface of the tubular pressing member 85 and the inner circumferential surface of the support hole 71*f* prevents the cam 71 from accidentally rotating relative to the additional folding roller 20. This prevents the rotation of the cam 71 relative to the additional folding roller 20 caused by an impact or the like that occurs during the jam processing to remove the jammed sheet and the movement of the cam 71 to the contact position at which the contact part 71*a* of the cam 71 contacts the guide plate 51. As a result, the difficulty in locking the guide plate 51 after the jam processing at the contact position can be reduced.

Figure 25:
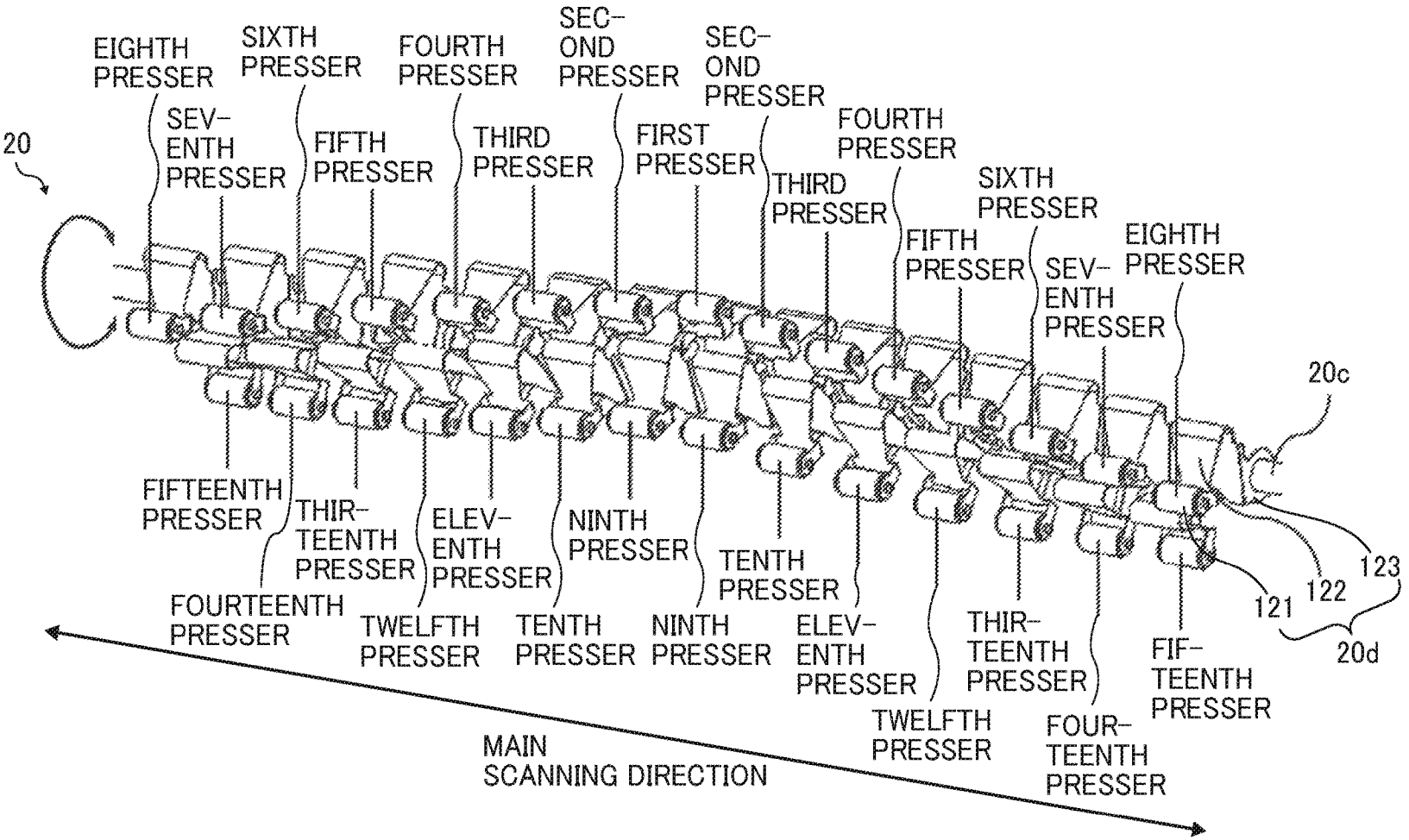
FIG. 25 is a perspective view illustrating a variation of the additional folding roller.

FIG. 25 is a perspective view illustrating a first variation of the additional folding roller 20.

The additional folding roller 20 in the first variation includes a plurality of pressers 20*d* disposed around the rotation shaft with a certain angular difference in the rotation direction of the rotation shaft 20*c* of the additional folding roller 20 and disposed with a certain interval in the main scanning direction.

Each presser 20*d* includes a fixing portion 123 to fix the presser on the rotation shaft 20*c*, a leaf spring 122, and a pressing roller 121 rotatably supported on a shaft parallel to the main scanning direction. The additional folding roller 20 of the first variation has two presser groups symmetrical about the center in the main scanning direction, each of which includes a plurality of pressers 20*d* disposed around the rotation shaft with a certain angular difference in the rotation direction of the rotation shaft 20*c* of the additional folding roller 20 and disposed with a certain interval in the main scanning direction. The first presser group includes from a first presser to an eighth presser in FIG. 25, and the second presser group includes from a ninth presser to a fifteenth presser in FIG. 25. In addition, the first presser group includes the presser positioning at a center of the two adjacent pressers of the first presser group in the rotation direction.

In the first variation, since the pressing rollers 121 serving as the pressing members are disposed around the rotation shaft with the certain angular difference in the rotation direction and disposed with the certain interval in the main scanning direction, the pressing rollers 121 can continuously press the folded portion of the sheet P from the center of the sheet to the both ends of the sheet in the main scanning direction to put the sharp crease in the sheet P.

Figure 26:
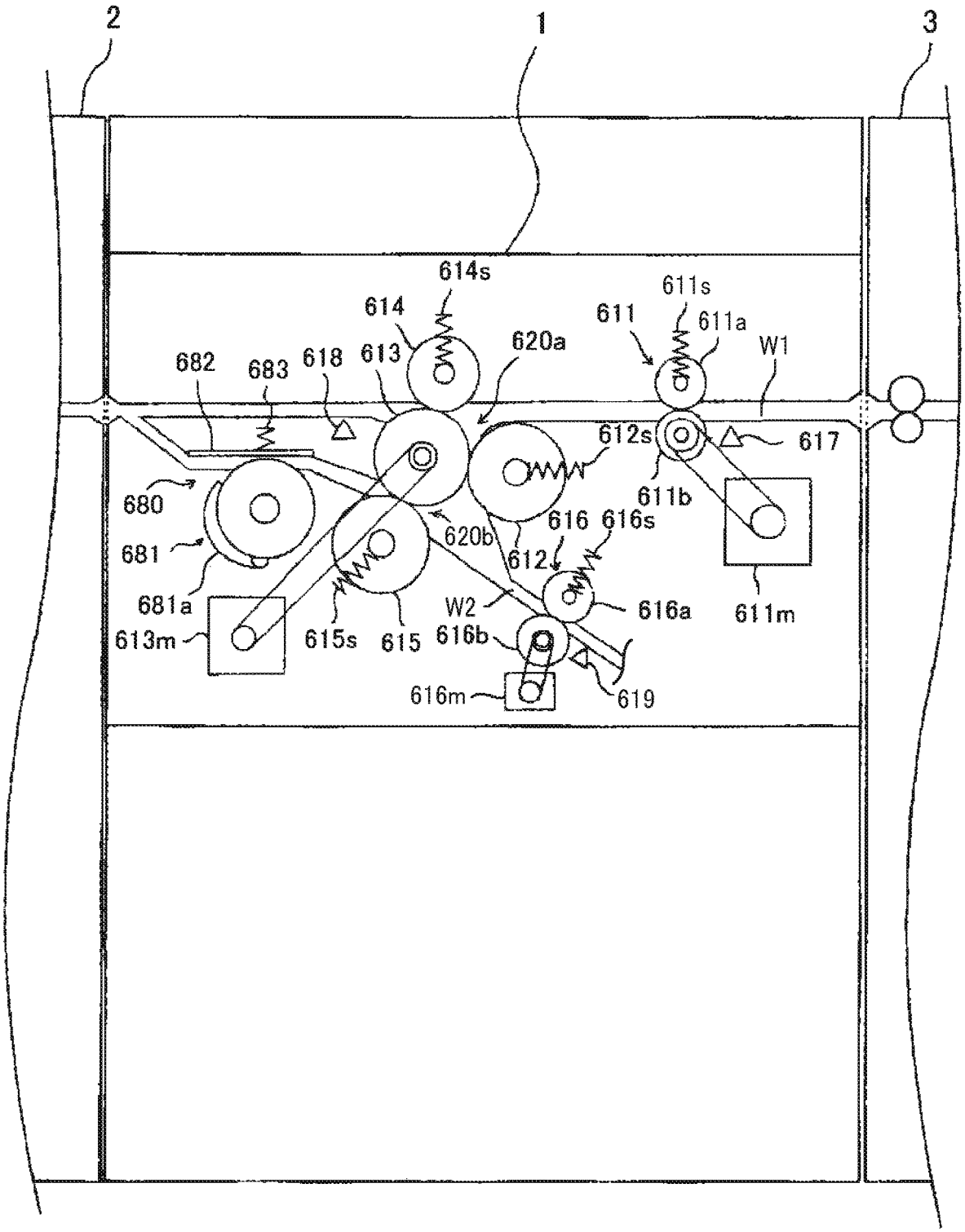
FIG. 26 is a schematic configuration diagram illustrating the folding apparatus of a second variation.

FIG. 26 is a schematic configuration diagram illustrating the folding apparatus of a second variation.

The folding apparatus of the second variation also includes the through conveyance path W1 to convey the sheet to the post-processing apparatus 2 at the subsequent stage without the additional folding processing. In addition, the folding apparatus of the second variation also includes the folding processing conveyance path W2 that branches from the through conveyance path W1, folds the sheet P, and conveys the sheet P to the post-processing apparatus 2 at the subsequent stage.

An entry roller pair 611 serving as a first conveyance member is disposed on an entrance side, which is the right side in FIG. 26, of the through conveyance path W1 that receives sheet P from the image forming apparatus 3. The entry roller pair 611 includes a pressing roller 611*a* serving as a rotating member and a driving roller 611*b* which is an opposing member. A driving force of an entry motor 611*m* that is a direct current (DC) motor as a driving source drives and rotates the driving roller 611*b*. In addition, there are a first folding roller 612, a first forward and reverse rotation roller 613 disposed in contact with the first folding roller 612, and a pressing roller 614 disposed in contact with the first forward and reverse rotation roller 613 on an exit side, which is the left side in FIG. 26, of the through conveyance path W1. The sheet P passes through a nip between the first folding roller 612 and the first forward and reverse rotation roller 613 to move from the through conveyance path W1 to the folding processing conveyance path W2. Or the sheet P passes through a nip between the first forward and reverse rotation roller 613 and the pressing roller 614 via the through conveyance path W1 to convey the sheet P to the post-processing apparatus 2 at the subsequent stage.

A second folding roller 615 is disposed in contact with the first forward and reverse rotation roller 613 on an exit side of the folding processing conveyance path W2. On the folding processing conveyance path W2, the second forward and reverse rotation roller pair 616 is disposed opposite the second folding roller 615 with respect to the nip between the first folding roller 612 and the first forward and reverse rotation roller 613 to which the sheet p enters from the through conveyance path W1. The second forward and reverse rotation roller pair 616 includes a pressing roller 616*a* that is a rotating member and a driving roller 616*b* that is an opposing member. A driving force of the forward and reverse rotation motor 616*m* that is a driving source drives and rotates the driving roller 616*b*.

A folding motor 613*m* that is the DC motor as a driving source can drive and rotate the first forward and reverse rotation roller 613 so that the first forward and reverse rotation roller 613 can rotate forward and reverse. All of the first folding roller 612, the pressing roller 614 and the second folding roller 615 which are disposed in contact with the first forward and reverse rotation roller 613 are driven rollers that are driven to rotate by the first forward and reverse rotation roller 613.

A forward and reverse rotation motor 616*m* that is the DC motor as a driving source can drive and rotate the driving roller 616*b* of the second forward and reverse rotation roller pair 616 so that the driving roller 616*b* can rotate forward and reverse. The pressing roller 616*a* of the second forward and reverse rotation roller pair 616 is a driven roller that is driven to rotate by the driving roller 616*b*.

The pressure springs 611*s*, 612*s*, 614*s*, 615*s*, and 616*s* serving as the pressure members press roller shafts of the driven rollers 611*a*, 612, 614, 615, 616*a* to form nips between the driven rollers 611*a*, 612, 614, 615, 616*a* and the respective opposing rollers.

On the upstream side of the entry roller pair 611 in the sheet conveyance direction, which is the entrance side of the through conveyance path W1, an entry sensor 617 as a sheet end detector to detect the end of the sheet P is disposed. The entry sensor 617 outputs to the controller 40 a leading edge detection signal indicating that the leading edge of the sheet P conveyed from the image forming apparatus 3 reaches the detection area of the entry sensor 617. As the entry sensor 617, a known sensor can be used.

On the downstream side of a second sheet conveyance unit configured by the first forward and reverse rotation roller 613 and the pressing roller 614 in the sheet conveyance direction, which is the exit side of the through conveyance path W1, a sheet detection sensor 618 as a sheet leading edge detector to detect the leading edge of the sheet P is disposed. The sheet detection sensor 618 outputs to the controller 40 a leading edge detection signal indicating that the leading edge of the sheet P conveyed from the through conveyance path W1 reaches the detection area of the sheet detection sensor 618. Similar to the above-described entry sensor 617, a known sensor can be used as the sheet detection sensor 618.

On the downstream side of the second forward and reverse rotation roller pair 616 in the sheet conveyance direction, which is opposite side of the exit side of the folding processing conveyance path W2, a sheet detection sensor 619 to detect the leading edge of the sheet P is disposed. The sheet detection sensor 619 outputs to the controller 40 a leading edge detection signal indicating that the leading edge of the sheet P conveyed from the through conveyance path W1 to the folding processing conveyance path W2 reaches the detection area of the sheet detection sensor 619. Similar to the above-described entry sensor 617 and the sheet detection sensor 618, as the sheet detection sensor 619, a known sensor can be used.

A second conveyance unit is configured by the first forward and reverse rotation roller 613 and the pressing roller 614, and a first folded portion forming unit 620*a* is configured by the first folding roller 612 and the first forward and reverse rotation roller 613. Additionally, in the present embodiment, a second folded portion forming unit 620*b* is configured by the first forward and reverse rotation roller 613 and the second folding roller 615.

As the second conveyance unit, an adhesion roller or an attraction belt may be adopted instead of the above-described roller pair. The second conveyance unit including the first forward and reverse rotation rollers 613 and the second folded portion forming unit 620*b* including the first forward and reverse rotation rollers 613 and the second folding roller 615 has the common roller. However, the second conveyance unit and the second folded portion forming unit 620*b* may be an independent structure configured by different rollers.

On the downstream side of the second folded portion forming unit 620*b* in the sheet conveyance direction, which is the exit side of the folding processing conveyance path W2, an additional folding unit 680 that presses the folded portion of the sheet to put the sharp crease is disposed. The additional folding unit 680 has the same configuration as the additional folding section C of the embodiment.

Figure 27A:
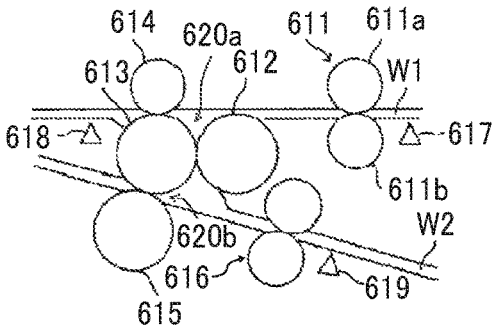
FIG. 27A to 27H are explanatory diagrams illustrating a general operation when the folding apparatus of the variation performs the Z-folding processing.
Figure 27B:
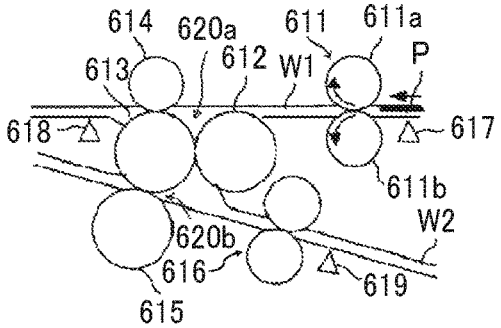

FIG. 27A to 27H are explanatory diagrams illustrating a general operation when the folding apparatus of the variation performs the Z-folding processing. Firstly, the entry sensor 617 detects the leading edge of the sheet P conveyed from the image forming apparatus. The controller 40 receives the leading edge detection signal output from the entry sensor 617 and controls the entry motor 611*m* to start a rotation of the entry roller pair 611 as illustrated in FIGS. 27A and 27B. When the leading edge of the sheet P enters the nip of the entry roller pair 611 after a start of the rotation of the entry roller pair 611, the entry roller pair 611 also conveys the sheet P on the through conveyance path W1 to the exit side.

Figure 27C:
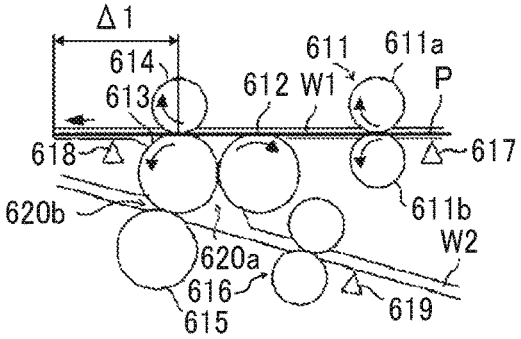

The leading edge of the sheet P conveyed on the through conveyance path W1 enters the nip between the first forward and reverse rotation roller 613 and the pressing roller 614. After the leading edge of the sheet P pass through the nip, the sheet detection sensor 618 detects the leading edge of the sheet P. The controller 40 receives the leading edge detection signal from the sheet detection sensor 618 which has detected the leading edge of the sheet P and performs the following control. That is, the controller 40 controls the folding motor 613*m* to stop the rotation of the first forward and reverse rotation roller 613 when the sheet P is conveyed by a predetermined conveyance amount Δ1 from the nip between the first forward and reverse rotation roller 613 and the pressing roller 614 as illustrated in FIG. 27C. At the same time, the controller 40 controls the entry motor 611*m* to stop the rotation of the driving roller 611*b* of the entry roller pair 611.

The conveyance amount Δ1 is appropriately determined depending on the length of the sheet P in the sheet conveyance direction and a content of the folding processing such as folding manner. The conveyance amount Δ1 of the sheet P can be obtained from, for example, a rotation amount of the pressing roller 614 from when the controller 40 receives the leading edge detection signal output from the sheet detection sensor 618.

Figure 27D:
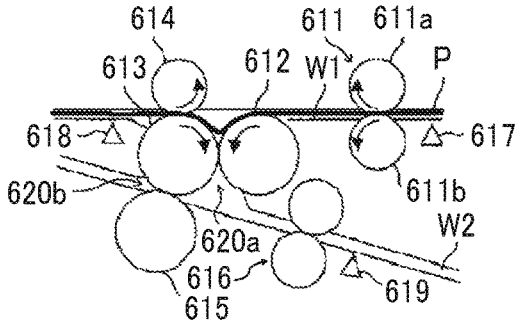
Figure 27E:
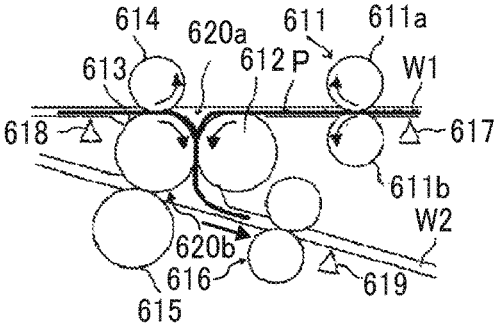

After the sheet P is conveyed by a predetermined conveyance distance Δ1, the controller 40 controls the folding motor 613*m* to start a reverse rotation of the first forward and reverse rotation roller 613 which returns the sheet P to the entrance side of the through conveyance path W1 and the entry motor 611*m* to start the rotation of the entry roller pair 611. As illustrated in FIG. 27D, the reverse rotation of the first forward and reverse rotation roller 613 and the rotation of the entry roller pair 611 forms a bend of the sheet between the entry roller pair 611 and the first forward and reverse rotation roller 613. The bend of the sheet, that is, a folded back portion, enters the nip between the first folding roller 612 and the first forward and reverse rotation roller 613, and the first folded portion is formed at the folded back portion. As illustrated in FIG. 27E, the first folded portion passes through the nip between the first folding roller 612 and the first forward and reverse rotation roller 613, enters the folding processing conveyance path W2, and is conveyed to the second forward and reverse rotation roller pair 616 on the folding processing conveyance path W2.

Figure 27F:
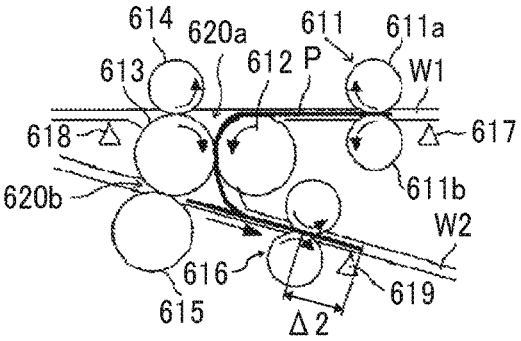

The first folded portion of the sheet P enters the nip of the second forward and reverse rotation roller pair 616 and is detected by the sheet detection sensor 619 after the first folded portion passes through the nip. The controller 40 receives the leading edge detection signal from the sheet detection sensor 619 which has detected the leading edge of the sheet P and performs the following control. That is, the controller 40 controls the folding motor 613*m* to stop the rotation of the first forward and reverse rotation roller 613 when the sheet P is conveyed by a predetermined conveyance amount Δ2 from the nip between the second forward and reverse rotation roller pair 616 as illustrated in FIG. 27F. At the same time, the controller 40 controls the forward and reverse rotation motor 616*m* and the entry motor 611*m* to stop the rotation of the second forward and reverse rotation roller pair 616 and the entry roller pair 611. The conveyance amount Δ2 is appropriately determined depending on the length of the sheet P in the sheet conveyance direction and a content of the folding processing such as folding manner. The conveyance amount Δ2 of the first folded portion of the sheet P can be obtained from, for example, a rotation amount of the second forward and reverse rotation roller pair 616 from when the controller 40 receives the leading edge detection signal output from the sheet detection sensor 619.

Figure 27G:
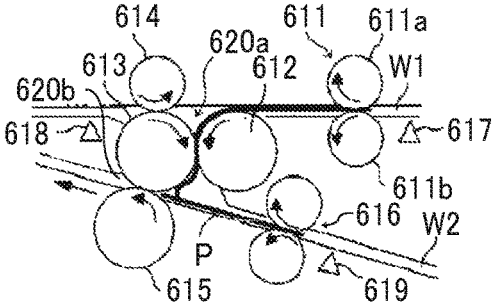

After the sheet P is conveyed by a predetermined conveyance amount Δ2, the controller 40 controls the forward and reverse rotation motor 616*m* to start a reverse rotation of the second forward and reverse rotation roller pair 616 which conveys the sheet P to the exit side of the folding processing conveyance path W2, the folding motor 613*m* to start the reverse rotation of the first forward and reverse rotation roller 613 again, and the entry motor 611*m* to start the rotation of the entry roller pair 611 again. As illustrated in FIG. 27G, this operation forms a bend of the sheet between the first forward and reverse rotation roller 613 and the second forward and reverse rotation roller pair 616. The above-described bend of the sheet, that is, a folded back portion, enters the nip between the first forward and reverse rotation roller 613 and the second folding roller 615, and the second folded portion is formed at the folded back portion.

Figure 27H:
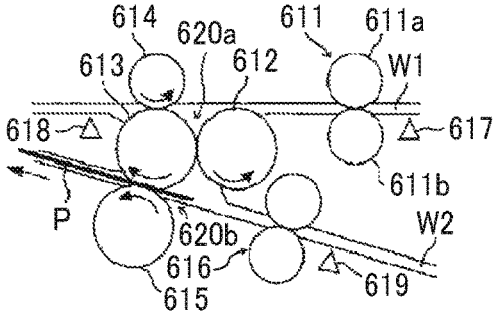

As illustrated in FIG. 27H, the second folded portion passes through the nip between the first forward and reverse rotation roller 613 and the second folding roller 615, and the first forward and reverse rotation roller 613 and the second folding roller 615 convey the second folded portion to the exist side of the folding processing conveyance path W2. The first forward and reverse rotation roller 613 conveys the sheet P including the two folded portions described above to the additional folding unit 680. Similar to the present embodiment, the additional folding unit 680 puts the sharp crease on the folded portions and conveys the sheet to the post-processing apparatus 2.

The embodiments described above are examples and provide advantages as below in a plurality of aspects 1 to 19.

First Aspect

The sheet processing apparatus according to a first aspect includes a pressing member such as the additional folding roller 20 rotatably supported. The pressing member includes a pressing portion such as the pressing portion 20*b* that is disposed in a predetermined range in a rotation direction of the pressing member to press the folded portion of the sheet. The sheet processing apparatus according to the first aspect also includes a guide such as the guide plate 51 opposite the pressing member and a contact member such as the cam 71 to contact the guide. The contact member such as the cam 71 is rotatably disposed at at least one end of the pressing member in an axial direction of the pressing member.

When the user removes the jammed sheet, the user releases the lock of the guide plate 51 that is generally locked and moves the guide plate 51 from the contact position at which the guide plate 51 contacts the pressing portion 20*b* or the contact part 71*a* to the retracted position to increase a space between the guide plate 51 and the pressing member and remove the jammed sheet. After the user removes the jammed sheet, the user returns the guide from the retracted position to the contact position and locks the guide so that the guide does not move to the retracted position.

When the user returns the guide plate 51 to the contact position after removing the jammed sheet, if the user returns the guide plate 51 to the contact position at which the contact part 71*a* or the pressing portion 20*b* contacts the guide plate 51, since the user pushes the guide plate 51 to the contact part 71*a* or the pressing portion 20*b* and locks the guide plate 51, locking the guide plate 51 is difficult, and a jam processing operation to remove the jammed sheet is not easy.

In contrast, according to the first aspect, since the contact member such as the cam 71 can rotate with respect to the pressing member such as the additional folding roller 20, a rotation of the contact member relative to the pressing member can form a region in which both the pressing portion 20*b* and the contact part 71*a* at which the contact member contacts the guide such as the guide plate 51 do not exist in the rotation direction. Positioning the above-described region in which both the pressing portion 20*b* and the contact part 71*a* do not exist opposite the guide allows locking the guide without pressing the guide, resulting in an easy jam processing operation.

In the present embodiment, as described above, when the user removes the jammed sheet, after the contact member is at a position at which the contact member does not contact the guide, the pressing member rotates relative to the contact member so that a non-pressing portion in which the pressing portion of the pressing member is not arranged is opposite the guide. This rotation forms a region in which both the contact part and the pressing portion do not exist in the rotation direction and positions the region opposite the guide. Or, for example, when the user removes the jammed sheet, the rotation of the pressing member may stop at a position at which the contact member contacts the guide, and, when the user locks the contact member, the user may rotate the contact member relative to the pressing member to form the region in which both the contact part and the pressing portion do not exist in the rotation direction and position the region opposite the guide.

After the guide is locked at the contact position, the contact member rotates relative to the pressing member to position the contact part of the contact member in the region in which both the contact part and the pressing portion do not exist in the rotation direction. After that, the contact member and the pressing member are engaged so that the contact member and the pressing member rotate together. Thus, in the additional folding processing, the contact member and the pressing member rotate together, and the pressing portion can press the folded portion of the sheet. In addition, when a portion opposite the guide is switched from the non-pressing portion to a pressing area which is a predetermined range where the pressing member is disposed, since the pressing portion of the pressing member does not hit the guide, the occurrence of impact sound can be avoided.

Second Aspect

In a second aspect, the contact member such as the cam 71 of the sheet processing apparatus according to the first aspect has a projection such as the projection 71*d* protruding in the axial direction, and the pressing member such as the additional folding roller 20 has a receiving portion such as the cutout portion 20*f* at at least one end of the pressing member in the axial direction to receive the projection such as the projection 71*d*. The receiving portion forms a space in which the projection such as the projection 71*d* moves in a predetermined range in the rotation direction.

In the second aspect, as described in the embodiment, contact between the projection such as the projection 71*d* and an end face of the receiving portion such as the cutout portion 20*f* on an upstream side in the rotation direction can rotate the contact member such as the cam 71 and the pressing member such as the additional folding roller 20 together. As a result, while the sheet processing apparatus processes the sheet, a non-pressing portion such as the non-pressing portion 20*e* is adjacent to a contact portion such as the contact part 71*a* of the contact member that contacts the guide, and the contact member such as the cam 71 and the pressing member can rotate together, which can prevent the occurrence of impact sound.

In addition, since the receiving portion forms the space in which the projection such as the projection 71*d* moves in the predetermined range in the rotation direction, the contact member can rotate relative to the pressing member in the predetermined range from when the projection contacts the end face of the receiving portion on the upstream side in the rotation direction to when the projection contacts an end face of the receiving portion on a downstream side in the rotation direction. Thus, it is possible to form the region in which both the contact portion and the pressing portion do not exist in the rotation direction.

Third Aspect

In a third aspect, the contact member of the sheet processing apparatus according to the second aspect has a contact portion such as the contact part 71*a* to contact the guide such as the guide plate 51, the pressing member has a non-pressing portion such as the non-pressing portion 20*e* in which the pressing portion of the pressing member is not disposed in the rotation direction, and, when the projection such as the projection 71*d* contacts one end face of the receiving portion such as the cutout portion 20*f* in the rotation direction, the contact portion such as the contact part 71*a* is adjacent to the non-pressing portion such as the non-pressing portion 20*e*.

In the third aspect, as described in the embodiment, a non-pressing portion such as the non-pressing portion 20*e* is adjacent to a contact portion such as the contact part 71*a* of the contact member that contacts the guide, and the contact member such as the cam 71 and the pressing member can rotate together, which can prevent the occurrence of impact sound.

Fourth Aspect

In a fourth aspect, the contact member such as the cam 71 of the sheet processing apparatus according to the second aspect has a contact portion such as the contact part 71*a* to contact the guide such as the guide plate 51, the pressing member such as the additional folding roller 20 has a non-pressing portion such as the non-pressing portion 20*e* in which the pressing portion of the pressing member is not disposed in the rotation direction, and, when the jammed sheet is removed, the contact portion takes a position in which the contact portion is not opposite the guide, the pressing member such as the additional folding roller 20 relatively rotates with respect to the contact member such as the cam 71 so that the non-pressing portion such as the non-pressing portion 20*e* is opposite the guide such as the guide plate 51.

In the fourth aspect, as described in the embodiment, when the jammed sheet is removed, since the pressing member such as the additional folding roller 20 does not press the guide such as the guide plate 51, the user can easily lock the guide plate 51 at the contact position, that is, the jam processing operation becomes easy.

Fifth Aspect

In a fifth aspect, the contact member such as the cam 71 of the sheet processing apparatus according to the second aspect has the contact portion such as the contact part 71*a* to contact the guide such as the guide plate 51, the pressing member such as the additional folding roller 20 has the non-pressing portion such as the non-pressing portion 20*e* in which the pressing portion of the pressing member is not disposed in the rotation direction, and, when the sheet is processed, the pressing member such as the additional folding roller 20 rotates with the contact member such as the cam 71 in which the contact portion such as the contact part 71*a* is adjacent to the non-pressing portion such as the non-pressing portion 20*e*.

In the fifth aspect, as described in the embodiment, the pressing portion 20*b* does not hit the guide such as the guide plate 51 immediately after the start of the additional folding processing, and the abutment 51*b* does not hit against the stopper 57 to stop a rotation of the guide immediately before the end of the additional folding processing. Therefore, the occurrence of impact sound during the additional folding operation can be reduced.

Sixth Aspect

In a sixth aspect, the sheet processing apparatus according to the first aspect includes a moving member such as the guide retracting member 55 to move the guide such as the guide plate 51 between a contact position at which the guide contacts the pressing portion such as the pressing portion 20*b* or the contact member such as the cam 71 and a separation position at which the guide separates from the pressing portion and the contact member and a lock such as the lock 61 to lock the moving member that positions the guide at the contact position. In the sixth aspect, when the user removes the jammed sheet, the user releases the lock such as the lock 61 and moves the moving member such as the guide retracting member 55 to move the guide such as the guide plate 51 from the contact position to the retracted position. This movement increases the space between the guide such as the guide plate 51 and the pressing member such as the additional folding roller 20. Therefore, the user can easily remove the jammed sheet.

In addition, since the guide is not pressed, the user can easily lock the moving member by the lock after the user removes the jammed sheet.

Seventh Aspect

In a seventh aspect, the contact member such as the cam 71 of the sheet processing apparatus according to the first aspect has a contact portion to contact the guide when the pressing portion such as the pressing portion 20*b* contacts the guide.

In the seventh aspect, as described in the embodiment, since the cam 71 or the pressing portion 20*b* certainly press the guide such as the guide plate 51 during the additional folding operation, the occurrence of the impact sound during the additional folding operation can be reliably avoided.

Eighth Aspect

In an eighth aspect, the contact member such as the cam 71 of the sheet processing apparatus according to the first aspect has a contact portion such as the contact part 71*a* to contact the guide such as the guide plate 51, and an outer diameter C1 of the contact portion such as the contact part 71*a* is the same as an outer diameter M1 of the pressing portion such as the pressing portion 20*b*.

In the eighth aspect, as described in the embodiment, when the contact of the guide such as the guide plate 51 is switched between the pressing portion and the contact portion of the contact member such as the cam, the above-described structure prevents the pressing portion or the contact portion from hitting the guide, which avoids the occurrence of the impact sound during the additional folding operation.

Ninth Aspect

In a ninth aspect, the contact member such as the cam 71 of the sheet processing apparatus according to the first aspect is disposed out of a sheet conveyance span.

In the ninth aspect, when the contact member such as the cam 71 contacts the guide such as the guide plate 51, the contact member does not interfere with sheet passing.

Tenth Aspect

In a tenth aspect, the contact member such as the cam 71 and the pressing member such as the additional folding roller 20 of the sheet processing apparatus according to the first aspect are separate members.

In the tenth aspect, the contact member such as the cam 71 can be configured to be rotatable with respect to the pressing member such as the additional folding roller 20.

Eleventh Aspect

In an eleventh aspect, the pressing portion such as the pressing portion 20*b* is arranged over a predetermined range in the axial direction, and a position of the pressing portion in the rotation direction is different according to a position in the axial direction.

In the eleventh aspect, as described in the embodiment, the pressing force by the pressing portion during the additional folding process is not distributed over the entire region in the axial direction but is concentrated on the entire folded portion of the sheet. Therefore, even when the load applied to the additional folding member such as the additional folding roller 20 is small, it is possible to apply a desired pressing force to the folded portion of the sheet, and as compared with the case of pressing the entire area in the axial direction during the additional folding processing, the load on the pressing member can be reduced.

Twelfth Aspect

In a twelfth aspect, the pressing portion such as the pressing portion 20*b* of the sheet processing apparatus according to the eleventh aspect is symmetrical about the center of the pressing member such as the additional folding roller 20 in the axial direction.

In the twelfth aspect, as described in the embodiment, the pressing portion 20*b* can continuously press the folded portion of the sheet P from the center in the axial direction to the both end portions. This can perform the additional folding processing more efficiently than the case in which the pressing portion continuously presses the folded portion of the sheet from one end to the other end in the axial direction.

Thirteenth Aspect

In a thirteenth aspect, the sheet processing apparatus according to the first aspect includes a film such as the film 56 disposed between the guide such as the guide plate 51 and the pressing member such as the additional folding roller 20.

In the thirteenth aspect, as described in the embodiment, a slide of the pressing portion of the pressing member on the film 56 prevents the folded portion of the sheet from being displaced from the additional folding position by the movement of the sheet.

Fourteenth Aspect

In a fourteenth aspect, the film such as the film 56 of the sheet processing apparatus according to the thirteenth aspect does not contact the contact member such as the cam 71.

In the fourteenth aspect, as described in the embodiment, when the contact member such as the cam 71 contacts the guide such as the guide plate 51, the sheet can pass through the gap between the film and the guide.

Fifteenth Aspect

In a fifteenth aspect, the contact member such as the cam 71 of the sheet processing apparatus according to the first aspect has a contact portion such as the contact part 71*a* to contact the guide such as the guide plate 51, a non-contact portion such as the non-contact part 71*b* which does not contact the guide, and a connecting part such as the connecting part 71*c* to connect the contact portion such as the contact part 71*a* and the non-contact portion such as the non-contact part 71*b*. The connecting part such as the connecting part 71*c* is formed by a tangent line of the non-contact portion.

In the fifteenth aspect, it is possible to prevent the connecting part 71*c* from contacting the guide such as the guide plate 51.

Sixteenth Aspect

In a sixteenth aspect, a portion connecting the connecting part such as the connecting part 71*c* and the contact portion such as the contact part 71*a* of the sheet processing apparatus according to the fifteenth aspect is curved.

In the sixteenth aspect, as described in the embodiment, for example, when the outer diameter of the contact part 71*a* of the cam 71 serving as the contact member becomes larger than the outer diameter of the pressing portion 20*b* due to a manufacturing tolerance, the above-described curve guides the guide plate 51 serving as the guide for the guide plate 51 to gradually approach and contact the pressing portion 20*b* so that the impact sound can be reduced.

Seventeenth Aspect

In a seventeenth aspect, the sheet processing apparatus according to the first aspect further includes at least one of a member to press the contact member such as the cam 71 against a face on which the pressing member is opposite the contact member in at least one of a radial direction of the pressing member and the direction of the rotation axis (end face 20*h* of the additional folding roller in FIG. 22) and a member to press the contact member against the face via another member (the tubular pressing member 85 in FIG. 24).

In the seventeenth aspect, as described in the embodiment, when the jammed sheet is removed, a predetermined frictional force generated between the face and the contact member prevents the contact member such as the cam 71 from rotating relative to the pressing member such as the additional folding roller 20 and the contact portion of the contact member from moving to a position opposite the guide such as the guide plate 51. This reliably avoids difficulty in locking the guide.

Eighteenth Aspect

In an eighteenth aspect, the static frictional force between the face and the contact member such as the cam 71 in the sheet processing apparatus according to the seventeenth aspect is weaker than a force required for the contact member such as the cam 71 to push up the guide such as the guide plate 51.

In the eighteenth aspect, as described in the embodiment, one end face of the contact portion of the contact member in the rotation direction contacts the guide to rotate the pressing member relative to the contact member. This leads the guide to the non-pressing portion in which the pressing portion of the pressing member is not disposed and the contact member to a position in which the contact member does not push the guide upward.

Nineteenth Aspect

In a nineteenth aspect, the image forming system includes an image forming apparatus to form an image on a sheet and the sheet processing apparatus according to the first aspect to perform processing on the sheet.

In the nineteenth aspect, noise during the sheet processing can be reduced, and the user can easily remove the jammed sheet.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A sheet processing apparatus comprising:

a rotatable pressing member including a pressing portion in a range in a rotation direction of the pressing member, the pressing portion configured to press a folded portion of a sheet;

a guide opposite the pressing member; and a contact member an end of the pressing member in an axial direction of the pressing member, the contact member configured to contact the guide, and the contact member being rotatable with respect to the pressing member.

2. The sheet processing apparatus according to claim 1, wherein the contact member has a projection protruding in the axial direction, and wherein the pressing member has a receiving portion at the end of the pressing member configured to receive the projection, the receiving portion forming a space, the receiving portion configured to permit the projection to move in the space within a range in the rotation direction.

3. The sheet processing apparatus according to claim 2, wherein the contact member has a contact portion configured to contact the guide;

the pressing member has a non-pressing portion at a different position in the rotation direction from the pressing portion; and the contact portion is adjacent to the non-pressing portion when the projection contacts one end face of the receiving portion in the rotation direction.

4. The sheet processing apparatus according to claim 2, wherein the contact member has a contact portion configured to contact the guide;

the pressing member has a non-pressing portion in at a different position in the rotation direction from the pressing portion; and the contact portion is not opposite the guide and the pressing member rotates with respect to the contact member so that the non-pressing portion is opposite the guide when a jammed sheet is removed.

5. The sheet processing apparatus according to claim 2, wherein the contact member has a contact portion configured to contact the guide;

the pressing member has a non-pressing portion in at a different position in the rotation direction from pressing portion; and the pressing member rotates with the contact member in which the contact portion is adjacent to the non-pressing portion when a jammed sheet is removed.

6. The sheet processing apparatus according to claim 1, further comprising:

a moving member configured to move the guide between a contact position at which the guide contacts at least one of the pressing portion or the contact member and a separation position at which the guide separates from the pressing portion and the contact member; and a lock configured to lock the moving member with the guide positioned at the contact position.

7. The sheet processing apparatus according to claim 1, wherein the contact member has a contact portion configured to contact the guide when the pressing portion contacts the guide.

8. The sheet processing apparatus according to claim 1, wherein the contact member has a contact portion configured to contact the guide; and an outer diameter of the contact portion is same as an outer diameter of the pressing portion.

9. The sheet processing apparatus according to claim 1, wherein the contact member is outside of a sheet conveyance span.

10. The sheet processing apparatus according to claim 1, wherein the contact member and the pressing member are separate members.

11. The sheet processing apparatus according to claim 1, wherein the pressing portion is arranged over a range in the axial direction and a position of the pressing portion in the rotation direction is different according to a position of the pressing portion in the axial direction.

12. The sheet processing apparatus according to claim 11, wherein the pressing portion is symmetrical about a center of the pressing member in the axial direction.

13. The sheet processing apparatus according to claim 1, further comprising:

a film between the guide and the pressing member.

14. The sheet processing apparatus according to claim 13, wherein the film does not contact the contact member.

15. The sheet processing apparatus according to claim 1, wherein the contact member has a contact portion configured to contact the guide, a non-contact portion that does not contact the guide, and a connecting part configured to connect the contact portion and the non-contact portion, the connecting part defined by a tangent line of the non-contact portion.

16. The sheet processing apparatus according to claim 15, wherein a portion connecting the connecting part and the contact portion is curved.

17. The sheet processing apparatus according to claim 1, further comprising at least one of:

a member configured to press the contact member against a face on which the pressing member is opposite the contact member in at least one of a radial direction of the pressing member or the axial direction of the pressing member; or a member configured to press the contact member against the face via another member.

18. The sheet processing apparatus according to claim 17, wherein a static frictional force between the face and the contact member is weaker than a force for the contact member to push up the guide.

19. An image forming system comprising:

an image forming apparatus configured to form an image on a sheet, and the sheet processing apparatus according to claim 1 to perform processing on the sheet.

20. The sheet processing apparatus according to claim 1, wherein the pressing member has a non-pressing portion at a different position in the rotation direction from the pressing portion; and the contact member has a contact portion configured to contact the guide, the contact portion being at the same position in the rotation direction as the non-pressing portion.

* * * * *